US009140436B2

(12) United States Patent
Lu et al.

(10) Patent No.: US 9,140,436 B2
(45) Date of Patent: Sep. 22, 2015

(54) CONFIGURABLE CEILING LIGHTING SYSTEM

(75) Inventors: Min-Hao Michael Lu, Castro Valley, CA (US); Peter Y. Y. Ngai, Alamo, CA (US); Michael Trung Tran, Oakland, CA (US); Jeannine M. Fisher, Oakland, CA (US)

(73) Assignee: ABL IP Holding, LLC, Conyers, GA (US)

( * ) Notice: Subject to any disclaimer, the term of this patent is extended or adjusted under 35 U.S.C. 154(b) by 488 days.

(21) Appl. No.: 13/464,826

(22) Filed: May 4, 2012

(65) Prior Publication Data

US 2012/0300437 A1 Nov. 29, 2012

Related U.S. Application Data

(60) Provisional application No. 61/486,698, filed on May 16, 2011.

(51) Int. Cl.
*F21S 8/00* (2006.01)
*F21V 21/005* (2006.01)
(Continued)

(52) U.S. Cl.
CPC ..... *F21V 21/005* (2013.01); *E04B 9/006* (2013.01); *F21S 2/00* (2013.01); *F21S 8/063* (2013.01); *F21S 8/065* (2013.01); *F21V 19/02* (2013.01); *F21V 21/048* (2013.01);
(Continued)

(58) Field of Classification Search
CPC ..... F21S 2/00; F21S 4/00; F21V 1/00; F21Y 2105/00; F21Y 2101/00; E04B 9/006
USPC ..... 362/147, 148, 227, 249.03, 404, 235
See application file for complete search history.

(56) References Cited

U.S. PATENT DOCUMENTS 3,247,368 A 4/1966 McHugh
6,527,406 B1 3/2003 Slesinger et al.
(Continued)

FOREIGN PATENT DOCUMENTS

DE 202008008695 12/2009
EP 2107858 10/2009
(Continued)

OTHER PUBLICATIONS

Jason Bruges Studio, "Mimosa" artwork informational page, circa Dec. 2010.
(Continued)

*Primary Examiner* — Anh Mai
*Assistant Examiner* — Jessica M Apenteng
(74) *Attorney, Agent, or Firm* — Beeson Skinner Beverly, LLP

(57) ABSTRACT

A configurable ceiling lighting system for a grid ceiling comprising at least one and preferably a plurality of driver panels having a bottom and a defined perimeter sized to allow the driver panel to be set into and retained within the grid openings of a ceiling grid. The driver panel has at least one and preferably a plurality of electrical connectors accessible from the bottom of the driver panel. At least one and preferably a plurality of light modules are provided having a light source and an electrical connector complimentary to the electrical connectors of the panel drivers. The light modules can be operatively connected to the bottom of the ceiling panel drivers at selected connection points to produced desired arrays of ceiling lighting fixtures to meet particular lighting needs.

35 Claims, 28 Drawing Sheets

(51) Int. Cl.

| | |
|---|---|
| ***E04B 9/00*** | (2006.01) |
| ***F21V 33/00*** | (2006.01) |
| ***F21S 2/00*** | (2006.01) |
| ***F21S 8/06*** | (2006.01) |
| ***F21V 19/02*** | (2006.01) |
| ***F21V 21/04*** | (2006.01) |
| ***F21V 23/00*** | (2015.01) |
| ***F21V 23/06*** | (2006.01) |
| *F21Y 105/00* | (2006.01) |

(52) U.S. Cl.
CPC ..... *F21V 23/008* (2013.01); *F21V 23/06* (2013.01); *F21V 33/006* (2013.01); *F21Y 2105/008* (2013.01)

(56) References Cited

U.S. PATENT DOCUMENTS

| | | | | |
|---|---|---|---|---|
| 7,481,562 | B2 | 1/2009 | Chua et al. | |
| 2010/0188867 | A1 | 7/2010 | Li | |
| 2010/0284185 | A1 | 11/2010 | Ngai | |
| 2011/0175533 | A1* | 7/2011 | Holman et al. | 315/130 |

FOREIGN PATENT DOCUMENTS

| | | |
|---|---|---|
| WO | WO 2009/050276 | 4/2009 |
| WO | WO 2010/042216 | 4/2010 |
| WO | WO 20121158723 | 9/2012 |

OTHER PUBLICATIONS

Tom Dixon Studio, "Flat Lamp" artwork informational page, circa Dec. 2010.

Extended European Search Report for Application No. EP 127866743, Jan. 13, 2015, European Patent Office.

* cited by examiner

CONFIGURABLE CEILING LIGHTING SYSTEM

CROSS-REFERENCE TO RELATED APPLICATIONS

This Application Claims the benefit of U.S. Provisional Application No. 61/486,698 filed May 16, 2011, which is incorporated herein by reference.

BACKGROUND OF INVENTION

The present invention generally relates to overhead lighting systems and more particularly to lighting systems that can be used with grid ceilings.

Grid ceilings are widely used, commonly in office buildings. They provide a false or secondary ceiling (also called a "dropped ceiling") below the structural ceiling of the building and create a plenum space above the secondary ceiling for hiding HVAC ducts, pipes, electrical wiring and the like. In a typical grid ceiling, a T-bar structure suspended from the structural ceiling provides a grid of rectangular openings, commonly 2' by 2' or 2' by 4' openings, into which ceiling tiles are set to produce a finished ceiling for a space.

Overhead lighting for grid ceiling systems is typically provided in the form of recessed lighting or ceiling suspended lighting fixtures. In the case of recessed lighting, suitably sized rectangular fixtures called "troffers" are placed in selected gird openings of the T-bar grid in the place of ceiling tiles. Recessed troffers typically are relatively deep and cumbersome fixtures that use fluorescent lamps as a light source. They have large bottom fixture openings flush with the grid ceiling that are either uncovered, as in parabolic troffers, or covered by a lens. The recessed troffers provide a pattern of large area sources of light on the ceiling grid.

An example of suspended lighting fixtures in common use with grid ceiling systems are linear fluorescent lighting fixtures, wherein elongated fixtures having a uniform cross-sectional shape are suspended below the ceiling by stems or cables. Suspended linear fluorescent lighting systems can provide direct or indirect lighting, or a combination of both, and typically come in standard length sections, such as 4, 8 or 12 foot sections, that can be suspended beneath the ceiling as stand-alone fixtures or in a system of fixtures joined together by connectors in continuous runs. The stems or cables that suspend the linear fluorescent lighting system are normally tied into the T-bar grid of the grid ceiling at suspension points, and power cords for each section or selected sections are normally dropped through the ceiling to the sections along the suspension cables or the inside of a hollow stem.

In the above-described conventional approaches to providing overhead lighting in spaces with grid ceilings, the overhead lighting is a fixed installation that is relatively labor intensive to install. Such systems cannot be readily modified or re-configured to meet particular or changing application requirements. Also, the light fixtures themselves each provide relatively large lumen packages which illuminate relatively large areas within the space. They do not lend themselves to versatile placement or to the clustering of sources of light for fine tuning lumen placement at particular task and non-task areas within the space. Instead, they follow the conventional lighting design paradigm, which is to uniformly light spaces based on the requirement from the most demanding visual task, resulting in wasted energy through over-lighting of the less visually demanding areas.

Ceiling spot lighting systems are also used to provide lighting within a space. Spot lighting may be built into a ceiling or may be ceiling mounted, such as on ceiling mounted tracks. Spot lighting systems are often used for accent lighting and have no or limited adjustability. In the case of track lighting, positional adjustment of the spot lights is limited to the orientation and range of the track. The tracks can also be unsightly and are not easily installed. Spot lighting can produce excessive shadows and does not provide enough illumination on most vertical surfaces when aimed at illuminating a horizontal work surface. Thus, spot lighting is not generally employed to provide the majority of illumination in an indoor space such as offices, schools, hospitals or retail environments.

SUMMARY OF INVENTION

The present invention provides a flexible, easily installed ceiling lighting system that allows lumen packages, and particularly relatively small lumen packages, to be readily configured on a ceiling, and particularly a grid ceiling, for satisfying various lighting requirements of a space. Lumen packages in the form of discrete light modules can be connected or "plugged" into or removed from the ceiling to create different lighting environments and to satisfy different lighting needs. Light modules can be spaced apart or clustered together in arrays that achieve relatively high application efficiencies. A high degree of flexibility in the placement of the light modules on the ceiling will allow a more precise amount of lumens to be directed to designated areas below the ceiling, with the amount of lumens being tailored to different visual tasks to be performed within the space. For example, lumen packages can be clustered to direct more lumens to work surfaces such as on desktops and the work surfaces of office furniture systems, and can be configured in less dense placements for circulation areas requiring fewer lumens.

The configurable ceiling lighting system of the invention is particularly adapted for use in grid ceilings. The system comprises at least one and preferably a plurality of easily installed driver panels having a bottom with an observable bottom surface and a defined perimeter sized to allow the driver panel to be set into and be retained within a grid opening of a ceiling grid such that the bottom surface of the driver panel becomes a part of the observable grid ceiling. Each of the driver panels has at least one and preferably a plurality of electrical connector means, such as banana plug sockets, which are accessible from the bottom of the driver panel, and which define connection points on the bottom of the panel. These electrical connector means are powered from an electrical power source such as an external source available the AC wiring in a building. The driver panels may have a planar low profile form factor to simulate the form of a ceiling tile.

The configurable ceiling lighting system of the invention further comprises at least one and preferably a plurality of light modules having a light source. The light modules have an electrical connector means complimentary to the electrical connector means of the driver panels, wherein the light module can be operatively connected to the bottom of the driver panels at any defined connection point. This allows the light modules to be operatively positioned at selectable points on a grid ceiling. The more connection points that are provided on the driver panel the more selectable positions there will be. Also, different driver panels can be provided with different patterns of connection points over the bottoms of the panels to expand the configurability of the system.

The electrical connector means of each panel driver are preferably recessed into the bottom of the driver panel and can be capped with removable and suitably unobtrusive cover means when unused. However, the invention contemplates the possibility of driver panel connector means that project from or recess into the bottom surface of the panel. The bottom surface of the driver panel can be textured to resemble the observable surfaces of other ceiling tiles of the grid ceiling in which they are installed, or it could be provided with other surface treatments for a desired aesthetic effect. The bottom surface of the driver panel could be presented by the bottom wall of a panel box or by one or more cover plates covering the bottom of the panel box.

In another aspect of the invention the light module has a footprint that is smaller than the size or footprint of the driver panel. The footprint of the light module would be small enough to allow more than one, and preferably a plurality of light modules, to be clustered on a single driver panel. For example, the driver panel could be a square or rectangular panel having a perimeter dimension of approximately two feet and the light module could have a footprint of no greater than about one foot square.

In still another aspect of the invention, the light sources for the light module are comprised of at least one, and preferably a cluster of diffuse area light sources, such as OLED panels. Preferably, the cluster of diffuse area light sources includes OLED panels that lie in different planes for providing a desired light distribution from a compact lumen package. The materials of the light module can be light weight materials having desired properties for providing a light module that is light in weight and easily connected to a driver panel at a selected connection point.

Other aspects of the invention will be apparent from the following specification and claims.

DESCRIPTION OF DRAWINGS

FIG. 16 additionally shows one of the radial arms of the light module's spider bracket inserted in the spider bracket retention means of the cassette frame.

DETAILED DESCRIPTION OF ILLUSTRATED EMBODIMENTS

Figure 1A:
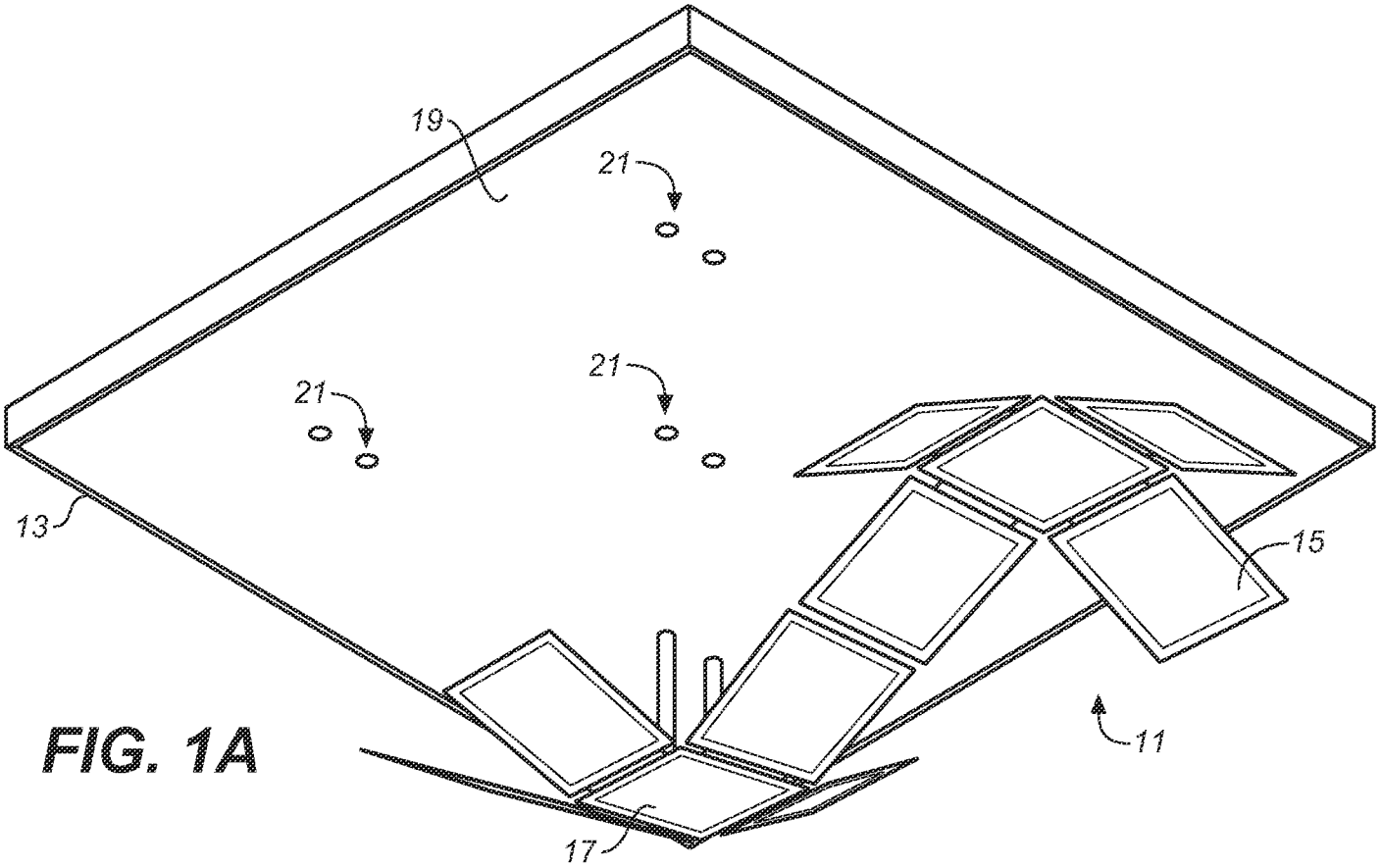
FIG. 1A is a bottom perspective view of a driver panel for the configurable ceiling lighting system of the invention with two light modules connected to the driver panel.

Referring now to the drawings, FIGS. 1A, 1B and 2-5 show the basic elements of a configurable ceiling lighting system in accordance with the invention. The configurable ceiling lighting system 11 includes at least one and suitably a plurality of ceiling driver panels 13, each preferably having a planar low profile form factor, and at least one and preferably a plurality of light modules 15, 17 that can be removably connected to the driver panels. Each driver panel fits within the grid framework of a grid ceiling system as hereinafter described and becomes part of the grid ceiling. Each has a bottom with an exposed bottom surface 19 which can simulate a ceiling tile of a grid ceiling system, but which could be provided with a wide variety of surface characteristics, including surface treatments for particular desired aesthetic effects. (As later described, desired surface treatments on the bottom of the driver panel could be provided by a separate bottom cover.) And each ceiling driver panel has at least one and preferably more than one electrical connector means 21 on its bottom surface to which the light modules 15, 17 can be operatively connected. Each connector means of each driver panel provides a selectable connection point on the ceiling at which a light module can be positioned for creating a ceiling lighting system that meets the particular lighting needs for the space below the ceiling. The light modules are preferably light in weight and compact with a small foot print, and have a connector means complementary to the connector means on the driver panels that provide for ease of installation of any driver panel at any chosen connection point on the driver panel. A light module utilizing Organic Light Emitting Diodes (OLEDs) can advantageously be used as light sources for such modules. A unique OLED light module is hereinafter described for use in configurable ceiling lighting systems in accordance with the invention. However, compact light modules using light sources other than OLED's could be used, for example, flat edge-lit LED waveguide panels or other large-area diffuse light sources such as QDLED or embedded nano crystals of III-V semiconductors.

Figure 3:
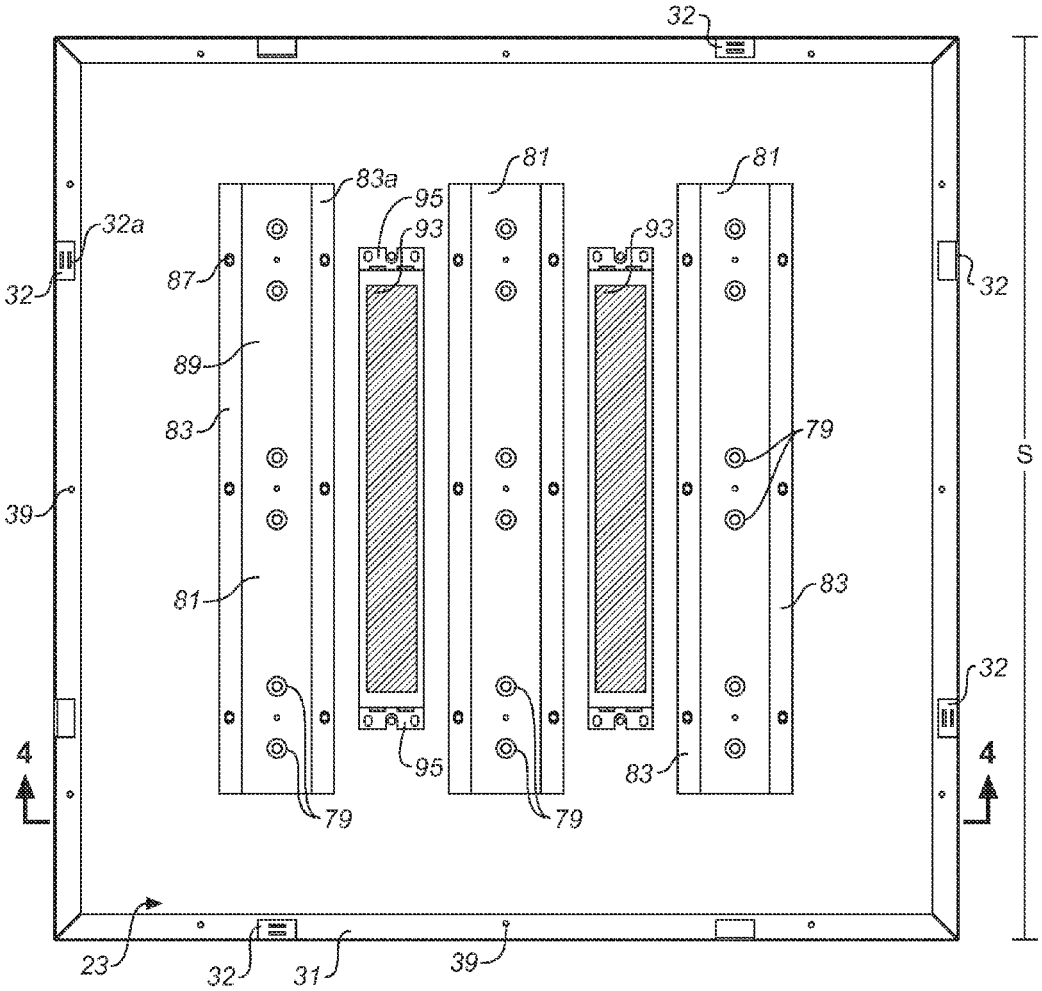
FIG. 3 is a top plan view of a driver panel illustrated in the foregoing figures with the driver panel box cover removed.
Figure 4:
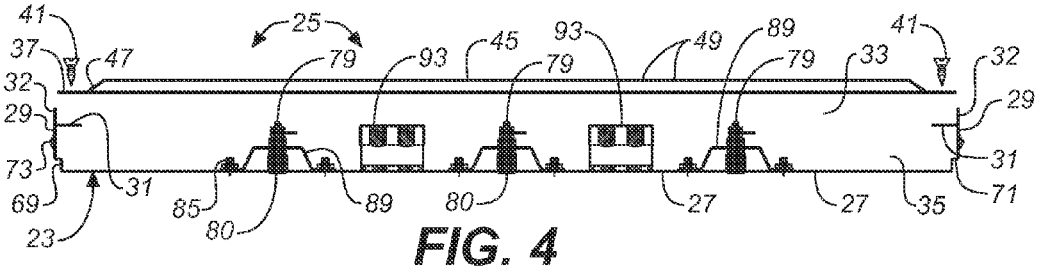
FIG. 4 is a cross-sectional view of the of the driver panel shown in FIG. 3 taken along lines 4-4 thereof, and showing the panel box cover exploded off of the driver panel box.

As shown in FIGS. 3 and 4, each driver panel can include a flat, open panel box 23 and panel box cover 25. The open panel box is formed by bottom wall 27 and perimeter side walls 29, which can include inwardly-turned edges 31 at least one of which, and preferably all of which, have bendable inset tabs 32 that can be used to secure the panel box to selected T-bars of the ceiling grid as later described. The height of the panel box side walls (denoted by the letter "h" in FIG. 5) is preferably chosen to keep the perimeter height of the driver panel 13 below the height of the T-bars of the grid ceiling. Generally, this height would be less than 1½ inches for most standard grid ceiling T-bar designs. However, driver panels having a height greater than 1½ inches are considered within the scope of the invention.

Figure 5:
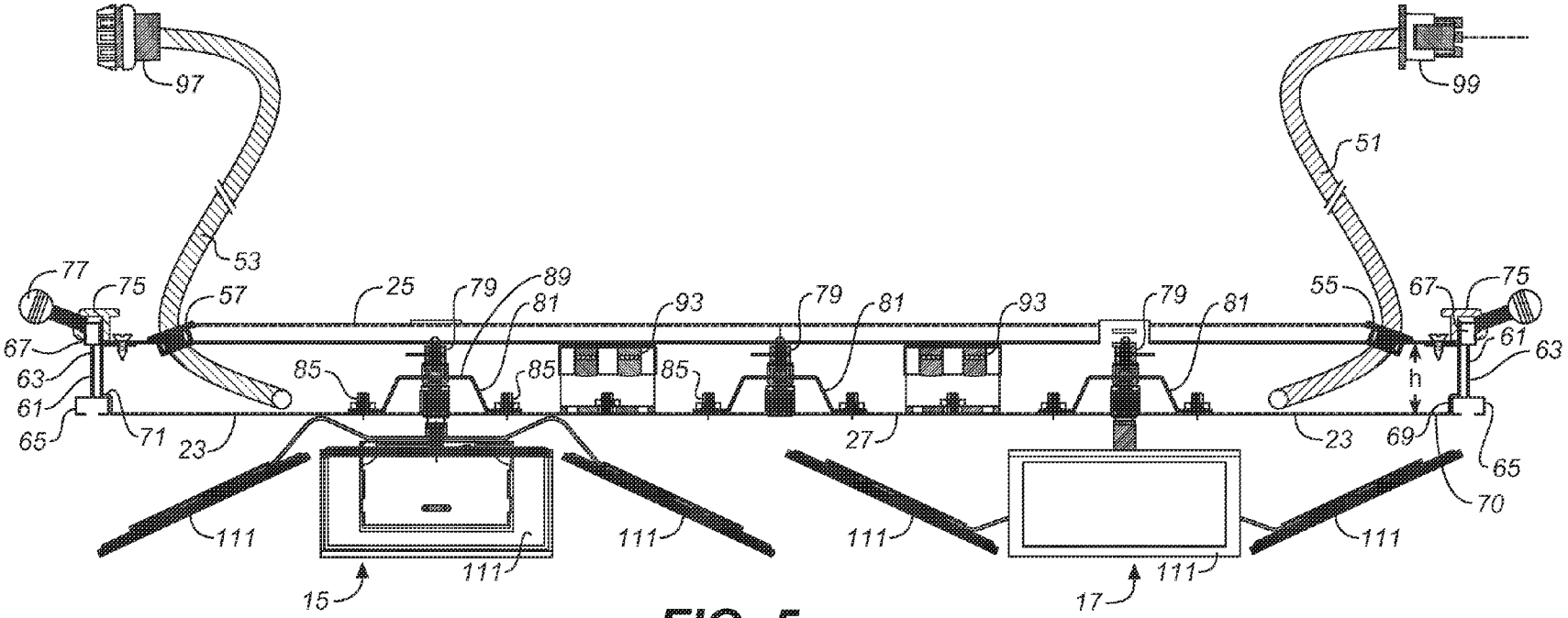
FIG. 5 is a cross-sectional view of the driver panel shown in FIG. 4, with the panel box cover attached to the driver panel box, and showing two light modules connected to the driver panel and the driver panel being held by the T-bars of a grid ceiling.

The panel box cover 25 fits over and covers the open top 33 of the panel box to form an interior compartment 35 within the driver panel for housing the connector means 21 and the hereinafter described electronic components and wiring of the driver panel. More specifically, the panel box cover is sized such that its perimeter edges 37 extend over the inwardly-turned edges of the open panel box. The inwardly-turned edges 31 of the open panel box and the perimeter edges 37 of the panel box cover can have overlapping screw holes, such as the illustrated screw holes 39 shown in FIG. 3, to allow the cover to be fastened to the top of the panel box by suitable fasteners, such as by the sheet metal screws 41 shown in FIG. 4. The central portion 45 of the panel box cover can be raised relative to the cover's perimeter edges to provide headroom in interior compartment 35 of the driver panel for the connector means and electronic components contained in the driver panel. This raised portion can have angled walls 47 that extend upwardly from the perimeter edges 37 to a raised top wall 49 inboard the perimeter edges. As shown in FIG. 5, wire cables 51, 53 for connecting one panel to the other, or to the building wiring, can be threaded through wire holes in the angled walls. The angled walls 49 cause the wire cables emerging from the driver panel to be pitched in a lateral direction to minimize bends in the wire cables connected between panels and in the cramped interior compartment of the driver panel. To protect the wire cables, grommets 55, 57 can be provided in the wire openings in the cover's angled walls 47.

As illustrated, the ceiling driver panels 13 are most suitably square or rectangular in shape to fit within the grid opening of a conventional grid ceiling. Nominal edge-to-edge dimensions for the panel drivers, denoted by the letter "S" in FIG. 3, could be two feet by two feet for a two foot by two foot grid ceiling. Actual dimensions would be slightly smaller so that the panel could fit between the grid ceiling T-bars. For example, a square driver panel designed to fit within the grid openings of a grid ceiling which holds two foot square acoustic ceiling tiles could be about 23.7 inches square. As above-mentioned, such a driver panel could simulate the two-by-two foot acoustic tiles normally used in the grid ceiling by suitable treatment of the bottom visible surface 19 of the driver panel.

It will be understood that it is not intended that the invention be limited to the use of driver panels having a particular perimeter shape or having particular dimensions. Driver panels in accordance with the invention could be provided with different perimeter shapes or dimensions that allow the panels to be adapted to different grid ceiling design options that might be presented, including but not limited to circular and triangular shapes.

The driver panel box and panel box cover can be fabricated of metal or of another suitable material. For example, fiberglass could be advantageously used to produce a driver panel that is relatively light in weight. Also, wire cable holes can be placed in the panel box cover in locations other than the angled walls of the raised portion of the cover, for example, in the raised top wall of the cover. A flat box cover could also be used, provided that electrical connectors and components for the driver panel can be selected which do not extend above the perimeter height of the panel.

It is noted that in the illustrated embodiment the bottom wall 27 of the open panel box 23 provides the exposed bottom surface 19 of the panel driver and that this bottom surface becomes part of the observable grid ceiling when the driver panel is installed in a ceiling grid. As above-mentioned, this bottom surface can be provided with different surface treatments to provide a desired appearance, including the look of a ceiling tile. Such surface treatments could be provided directly on the bottom wall of the panel box, or, alternatively, they could be provided by a separate bottom cover (not shown) placed under the bottom wall, in which case the bottom cover would be considered part of the bottom of the panel driver whose exposed bottom surface becomes the bottom of the cover. The bottom cover could, for example, be a thin ceiling tile. The bottom cover would have accommodations for the electrical connector means that are accessible from the bottom of the driver panels.

FIG. 5 illustrates how the illustrated driver panel can securely fit within the grid openings of a grid ceiling and held in place to the T-bars of the grid ceiling. Shown are two opposite and parallel T-bars 61, each having a vertical wall 63, a laterally extending cross-foot 65 at the bottom of the vertical wall, and an enlarged top rail 67 at the top of the vertical wall. The perimeter height, "h", of the driver panel is seen to be smaller than the height of the T-bar, roughly extending from the bottom of its cross-foot 65 to the bottom of its top rail 67. An inward step 69 along the bottom edges 70 of the driver panel box 23 provides a shoulder surface 71 that can rest on the box-shaped cross-foot of the T-bar type shown in FIG. 5, while allowing the bottom wall 27 of the driver panel to lie in a plane substantially flush with the bottom of the T-bars and other panel elements of the grid ceiling. With other types of T-bars, for example, ones having a longer flat cross-foot instead a short box-shaped cross-foot as shown, the cross-foot would support the panel by extending under the panel's bottom wall 27.

As above-mentioned, the edge-to-edge dimensions, S, of the panel will preferably be slightly less than the T-bar-to-T-bar spacing of the ceiling's T-bar grid, leaving a small gap between the panel's perimeter side walls 29 and the vertical walls 63 of the T-bar. To provide positive engagement between the sides of the panel and the T-bar's vertical wall, the vertical wall of the panel box can be provided with spring detents 73 (shown in FIG. 3 only) that press against the T-bars when the panel box is placed in a ceiling grid opening. Once placed in the grid opening the driver panel can be locked onto the T-bars.

The panel driver is locked onto the T-bars using locking clips 75 and thumb screw 77 in connection with the selected ones of the tabs 32 provided along the inwardly-turned edges 31 of the panel box 25. Prior to attaching the panel box cover 25 to the panel box, selected ones of the inset tabs are bent from their inset position within the inwardly-turned edges to an upright position as show in FIGS. 4 and 5. Openings 32*a* in the tabs facilitate bending using a tool, such as a flat head screw driver, which can be inserted into the openings. With the bent-up tabs, the panel driver can be slid down in between the T-bars of the T-bar opening until it bottoms against the cross-foot 65 of the T-bars. As shown in FIG. 5, the locking clips 75 with thumb screws 77 can be then snapped over the T-bars' top rails 65 and bent-up tabs and the thumb screws tightened. These locking clips will lock the panel box to the ceiling grid and prevent unintended dislodgement of the driver panel from the grid ceiling, such as during an earthquake.

It is noted that the bent-up tabs 32 of the panel box of the driver panel can also advantageously be used as attachment points for tie wires (not shown) that run to the overhead structural ceiling and that may be required by local building codes.

The components contained within the driver panel include the light module connector means 21, which can comprise at least one, and preferably a pre-figured array of banana plug sockets 79 mounted to the bottom wall 27 of panel box 25. As will be later described, the banana plug sockets can be located at different positions in the driver panel, and can be provided in regular or irregular patterns.

Figure 1B:
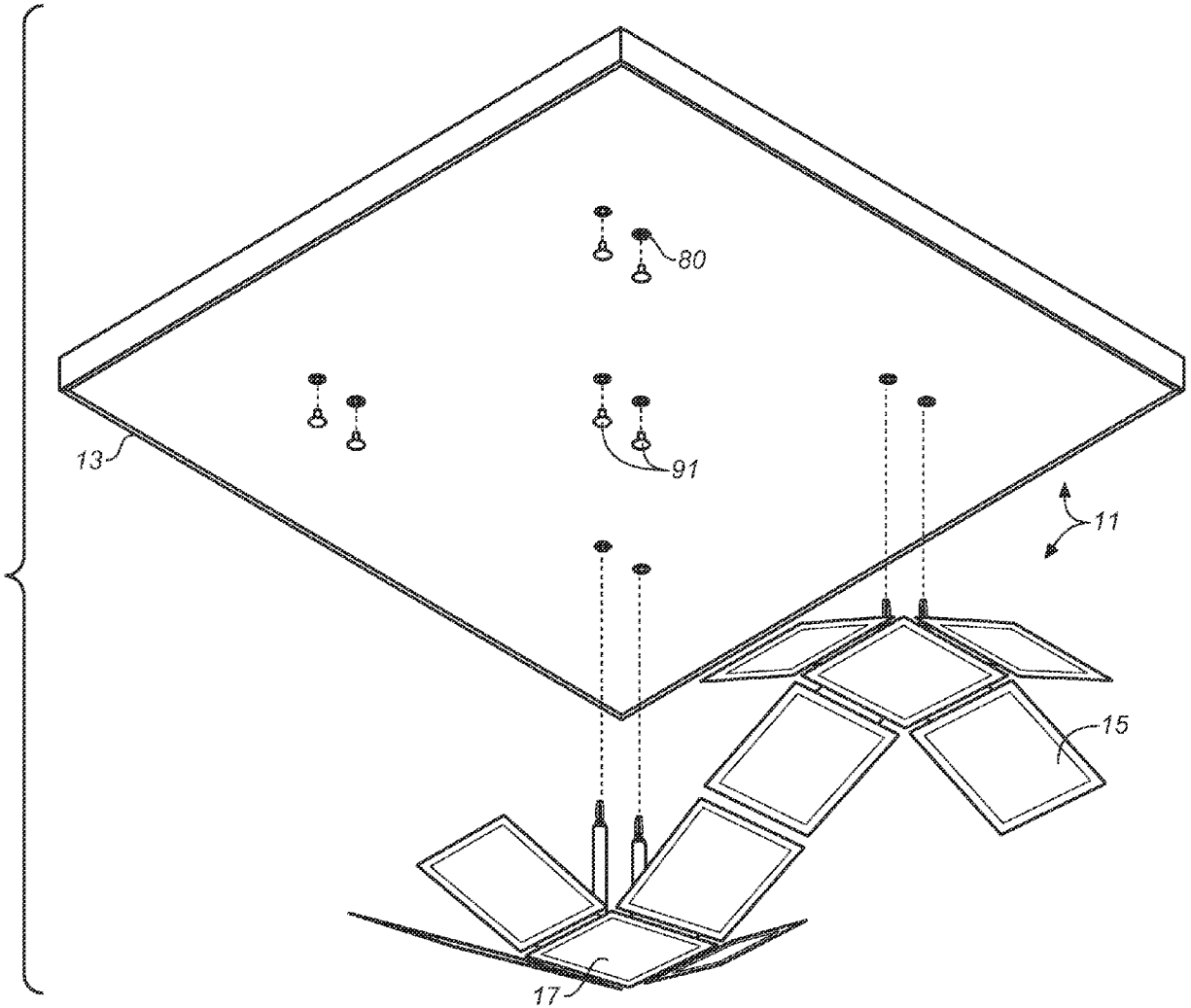
FIG. 1B is an exploded bottom perspective view thereof showing the light modules exploded away from the driver panel.
Figure 2:
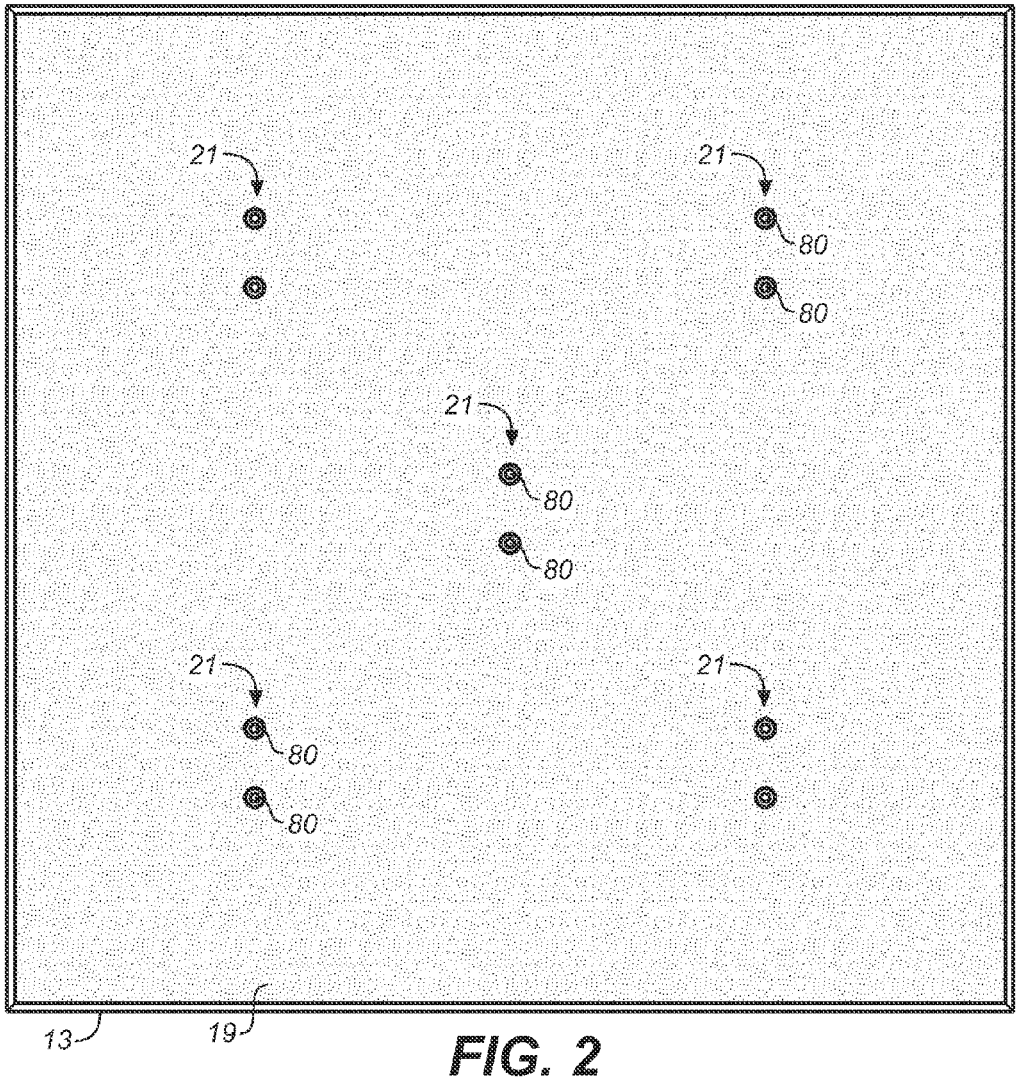
FIG. 2 is a bottom plan view of the drivel panel shown in FIGS. 1A and 1B.
Figure 6:
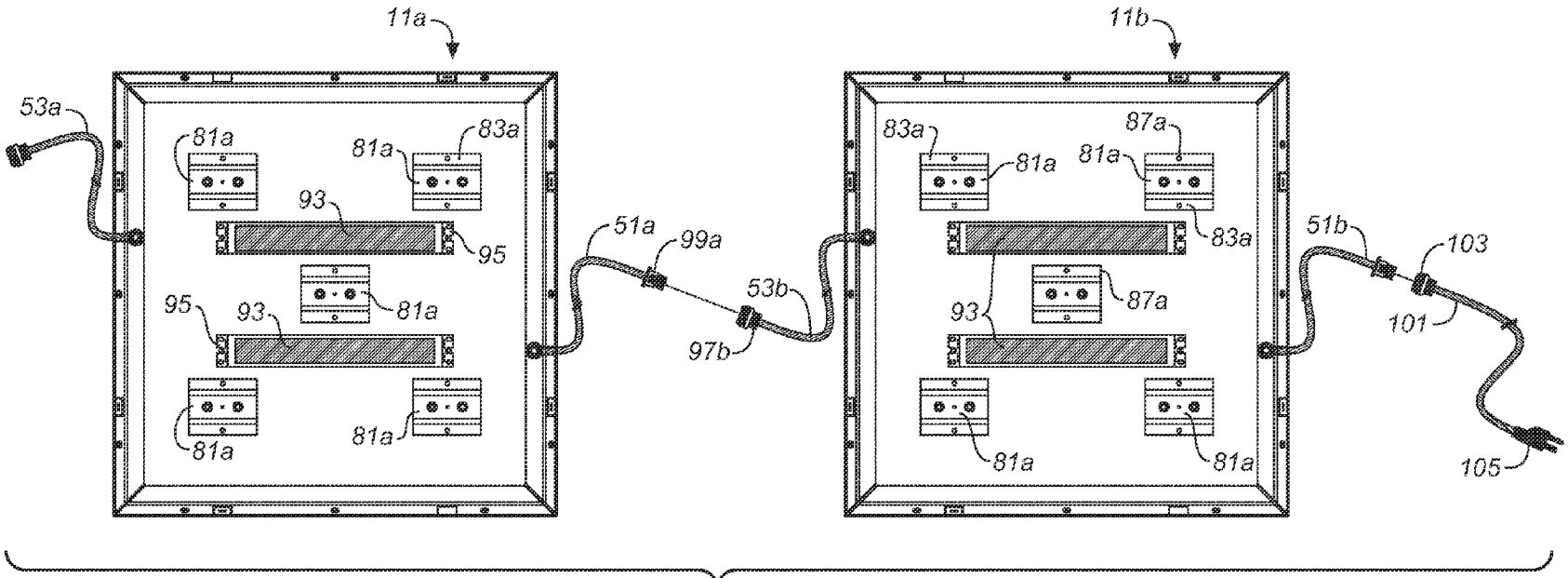
FIG. 6 is a top plan view of two driver panels for the configurable ceiling lighting system of the invention with the panel box cover shown in dashed lines to reveal the components contained within the driver panels and showing wire cable "pigtails" for electrically connecting panels together, and additionally showing a power cord for the lighting system.

In FIGS. 3-4, an array of nine pairs of banana plug sockets 79, each pair providing for a positive and negative electrical connection, are mounted in rows to the panel box bottom wall by means of three elongated and inverted U-shaped mounting brackets 81. FIG. 6 shows an example of another possible array of banana plugs, in this case an array of five banana plug socket pairs with each banana plug socket pair being held by individual short inverted U-shaped brackets 81*a*. In each case, the brackets 81, 81*a* used to support the banana plug pairs can be mounted in their intended position by securing the laterally extending feet 83, 83*a* of the brackets to the panel box's bottom wall by suitable fasteners, such as a flat head screw and nut 85. (Mounting holes 87, 87*a* are suitably provided in the bracket feet for this purpose.) The banana plug sockets are retained by the elevated top wall 89 of each mounting bracket so as to be oriented substantially perpendicular to the panel box's bottom wall and so that the insertion openings 80 of the sockets face through the bottom wall of panel box. Pre-drilled holes in the bottom wall of the panel box will allow the sockets' insertion openings to be accessible from the bottom of the driver panel, and preferably the sockets will be positioned such that the entry points for the insertion openings are substantially flush with the exposed bottom surface 19 of the driver panel. When not in use, these openings can be covered with suitable and unobtrusive cap plugs 91 as shown in FIG. 1B. (If a bottom cover is used underneath the bottom wall of the panel box as above-described, the sockets can be positioned such that the entry points for the insertion openings are substantially flush with the bottom surface of the cover, which now becomes the bottom surface of the driver panel. The cover would be provided with suitably sized and positioned openings for accommodating the entry point ends of the banana plugs.)

Other components contained in the driver panel can include voltage supply means such as ballast transformers for delivering the required voltage to the electrical sockets. The versions of the driver panels shown in FIGS. 3-5 and in FIG. 6 each contain two ballast transformers 93 interspersed between the banana plug socket mounting brackets, with each of the ballasts being mounted to the bottom wall of the driver panel box via mounting flanges 95. Two ballasts are provided in order to accommodate the number of banana plug socket pairs shown. (A ballast with four sets of wires can typically be used for four socket pairs.) The number of ballasts required in the driver panel will depend on the number of sockets provided in the panel.

Figure 7:
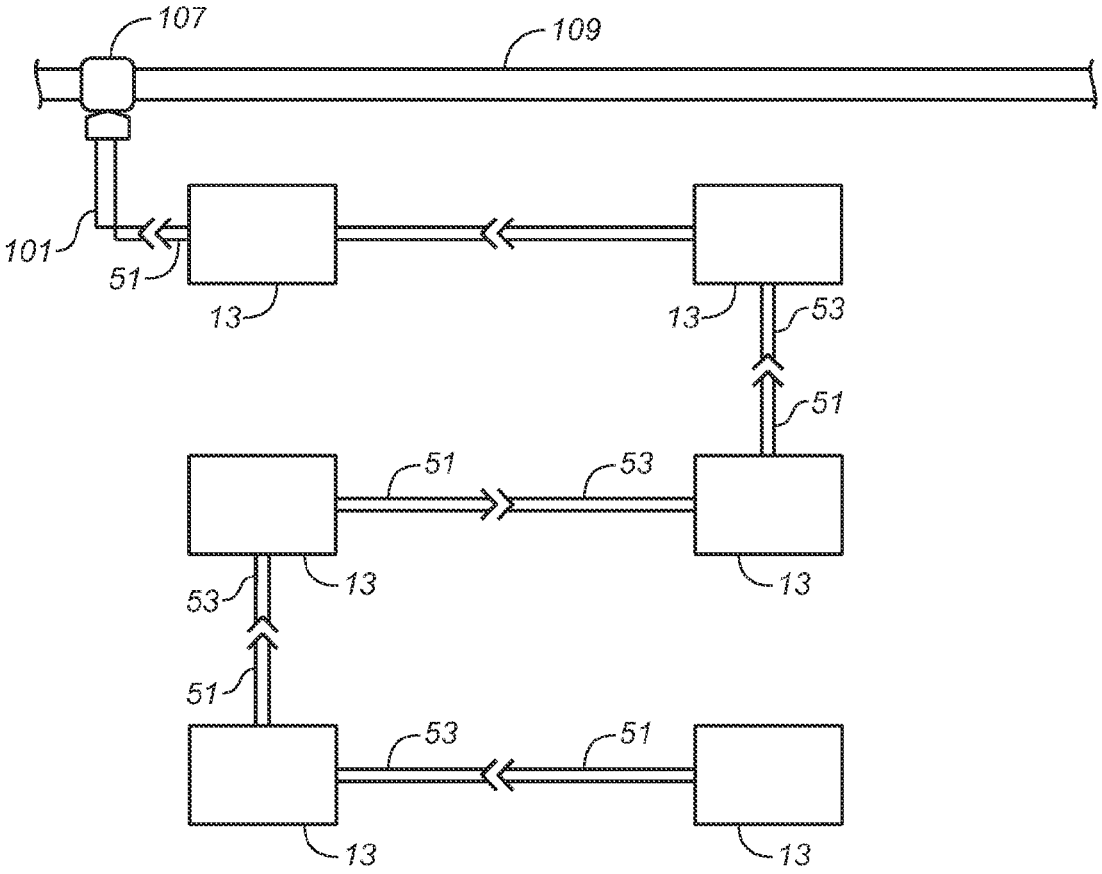
FIG. 7 is a schematic drawing of a plurality of driver panels for a configurable ceiling lighting system in accordance with the invention, which are daisy chained together and connected to wiring in a building.
Figure 8:
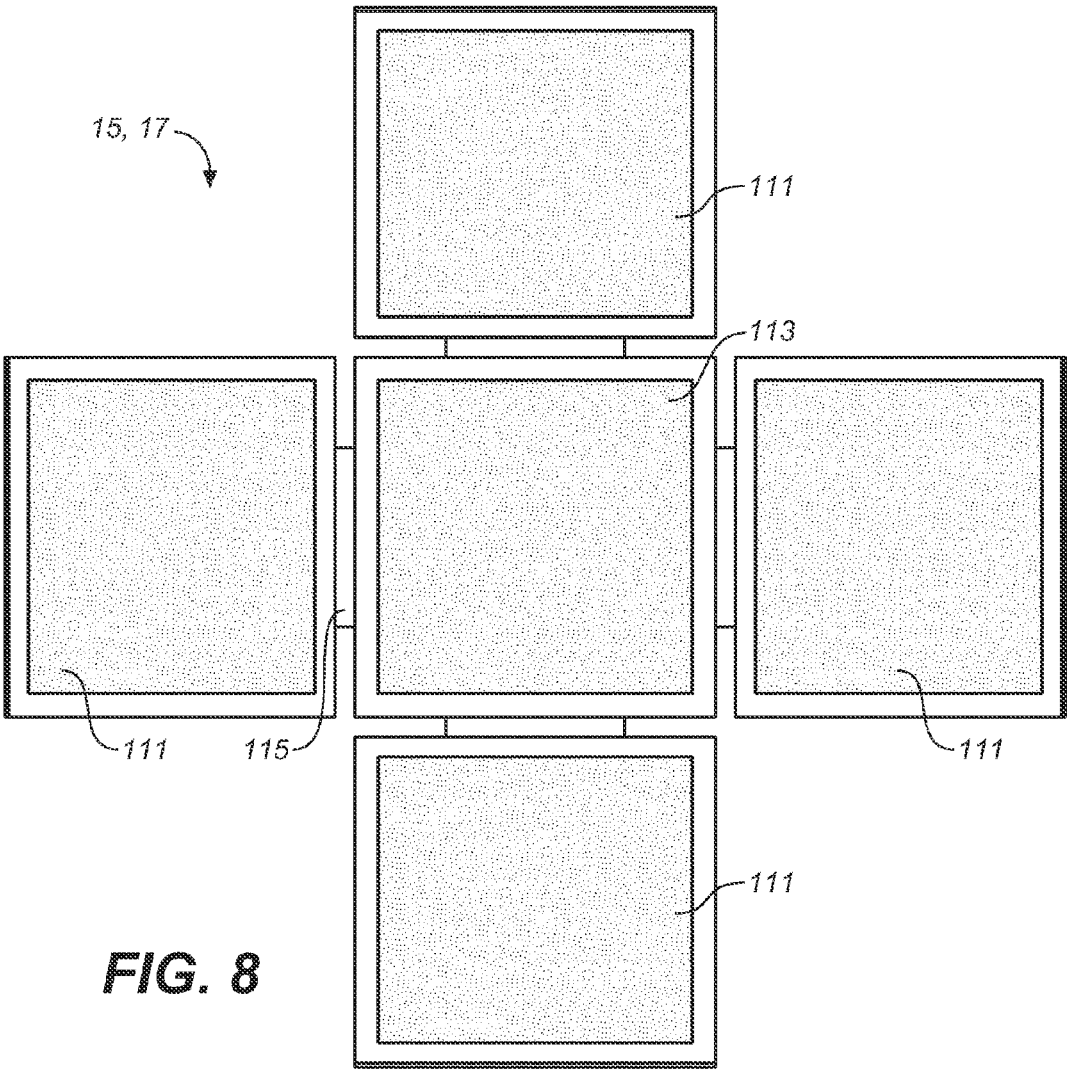
FIG. 8 is a bottom plan view of a unique light module for use in a configurable ceiling lighting system in accordance with the invention.
Figure 9:
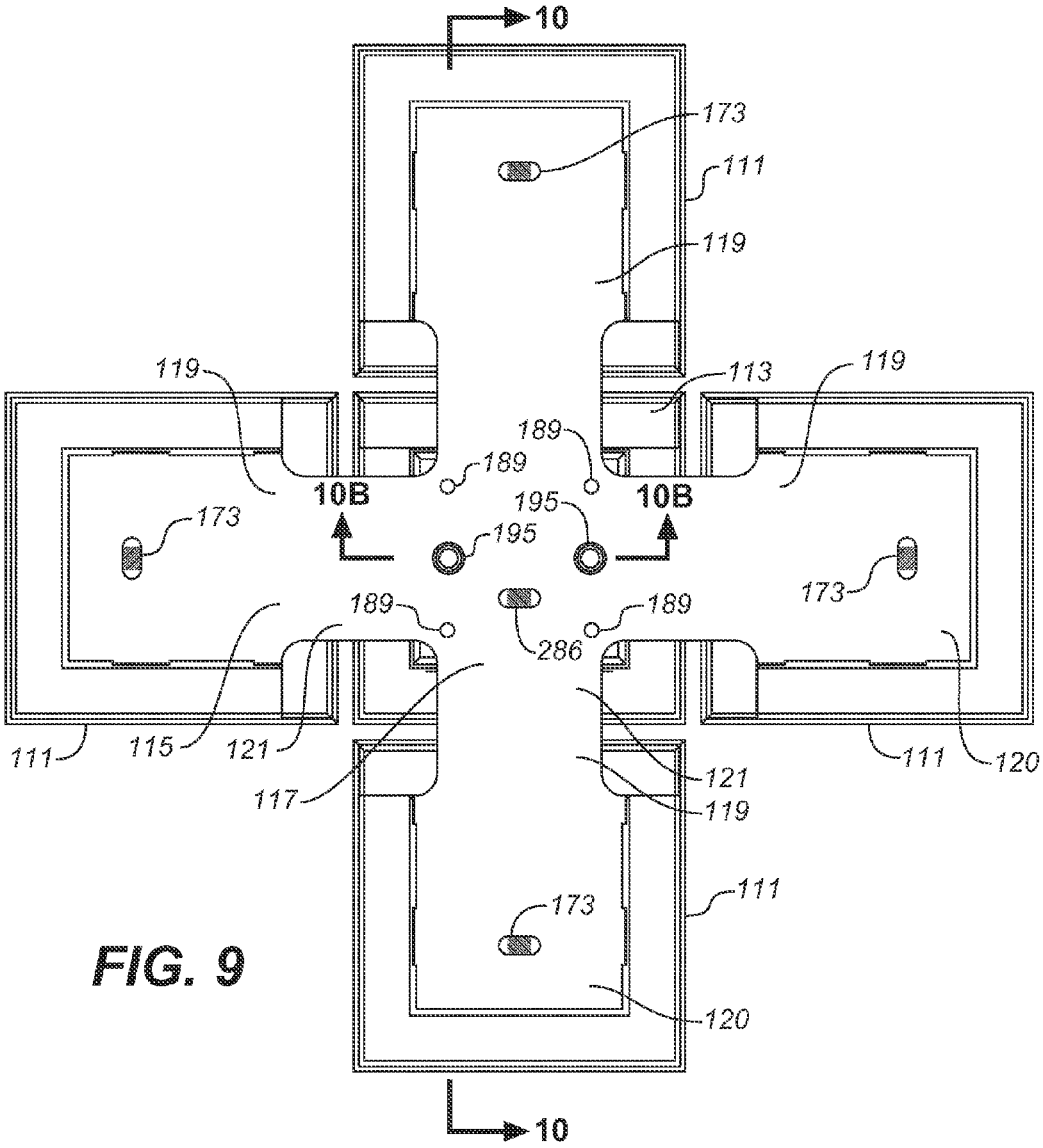
FIG. 9 is a top plan view thereof.

FIGS. 6 and 7 illustrate how, after a plurality of the above-described driver panels are inserted at desired locations in a grid ceiling system, they can be electrically interconnected or daisy chained together, and then connected to the building voltage supply. In FIG. 6, two panels 11*a* and 11*b* are shown, each having incoming and outgoing wire cables or "pigtails" 51*a*, 53*a* and 51*b*, 53*b* extending out from the top cover (shown in dashed lines) of the driver panels. Two wire pigtails are provided for each driver panel, one having a female connector and the other having a complimentary male connector. Preferably, these wire pigtails emerge from opposite sides of the panels, however, the pigtails could emerge from any side of the panel or, as mentioned above, from the top of the panel. One driver panel, for example panel 11*a*, is connected to another driver panel, for example panel 11*b*, in the grid ceiling by simply plugging the male pigtail end of the one panel to the female pigtail end of the other panel; for example, male connector 99*a* of pigtail 51*a* of panel 11*a* can be connected to female connector 97*b* of pigtail 53*b* of panel 11*b*. If the pigtails are not long enough to stretch between the grid ceiling locations of the driver panels, then a suitable extension with complimentary male and female connectors can be provided to span the distance required. An additional power cord 101 can be provided having a female connector end 103 that is complimentary to the male pigtail connectors of the driver panels, and a male plug end 105 for plugging into an electrical outlet provided by the building. Using power cord 101, the end panel in a chain of panels can be plugged directly into a building's electrical power.

While the above-described approach to electrically interconnecting panels and making connection to a building's electrical power is considered the best mode of the invention, other approaches are possible. For example, a driver panel, designated a master panel, could have its own power cord, instead of a male end pigtail, that can be plugged directly into the power outlet of the building. Other driver panels, designated slave panels, would then be daisy chained together as above-described and connected to the master panel. Other approaches to electrifying each panel would be possible, such as, for example, providing one or more power strips above the grid ceiling, which are connected to the building's electrical lines and into which each driver panel can be plugged. The driver panels could also be used in and powered by an integrated ceiling system such as the TechZone® ceiling system by Armstrong.

FIG. 7 schematically illustrates a plurality of daisy chained driver panels 13 electrically interconnected by female and male wire pigtails 51, 53, and plugged into an electrical outlet 107 for the building's wiring 109 via power cord 101.

As above-mentioned, OLEDs can advantageously be used as light sources for the light modules that are connectable to the driver panels of a configurable ceiling lighting system in accordance with the invention. While the use of other light sources in the light modules of a configurable ceiling lighting system as described above are possible and within the scope of the invention, it has been discovered that OLEDs can be used to create a light module which is very light in weight and which presents a very compact lumen package that is well adapted to meeting different and varied lighting needs within a space through different clustering of the modules on a ceiling. A new and innovative OLED light module for use with the configurable ceiling lighting system is now described with reference to FIG. 5 and FIGS. 8-16.

The OLED light modules 15, 17 each comprise a plurality of OLED cassettes 111, 113 attachable to and held in a tight cluster by a spider bracket 115 having a substantially flat center hub section 117 and radial arms 119 extending from the center hub section. In the illustrated embodiments of the light modules, the spider bracket has four radial arms with a ninety degree separation between arms for holding four outboard OLED cassettes 111 at ninety degrees to each other. A fifth center OLED cassette 113 is held to the center hub section of the spider bracket between the outboard OLED cassettes to form a cluster of OLED cassettes with planar OLED light sources that face and emit light into the space below the driver panel to which the light module is connected. The outboard OLED cassettes can be angled relative to the center cassette, either down as in light module 15 or up as in light module 17. It can be seen that this causes each of the OLED cassettes, and thus the OLED panels, contained therein to lie in a different plane. By providing a light module with clustered OLED panels in different planes, light distributions can be achieved that allow spaces below the light module to be efficiently illuminated.

A suitable angulation of the outboard OLED cassettes relative to the center cassettes is about 25 degrees, and a suitable size for the OLED cassettes is approximately 4 inches square. The resulting light module produces a lightweight lumen package that that can weigh less than one pound, that can fit within a 1×1 foot footprint, and that can be configured on a ceiling having driver panels in accordance with the invention to address a wide variety of space illumination requirements. All of the OLED cassettes can be structurally identical or substantially identical so that any OLED cassette can be used interchangeably with another OLED cassette of the light module.

The spider bracket of the light modules 15, 17 can be a thin unitary bent part, which is preferably fabricated of a strong, lightweight sheet material that holds its shape after bending. A thin spider bracket having these characteristics and a thickness of about 50 mils (0.050 inches) can be can be fabricated of a plastic-aluminum composite sheet material such as Reynobond® manufactured by Alcoa Inc. The radial arms 119 of the spider bracket include end connector members for holding the outboard OLED cassettes, and extension sections, which are denoted by the numeral 121 in the case of light module 15 and the numeral 123 in the case of light module 17. In the illustrated embodiment, the end connector members are in the form of flat connector plates 120, which can slide into the OLED cassettes as hereinafter described for easy attachment of the outboard OLED cassettes to the spider bracket. The extension sections of the radial arms can be bent to place the bracket's radial arms in a different plane than the center hub section. (Knock-outs, not shown, can be punched into the extension sections to facilitate bending.) They can also be designed to hide wires running between the center of the light modules and the outboard OLED cassettes. For example, in the arm-down version 15 of the light module, the bent extension section 121 provides an upward projecting arch 122 into which wires can be tucked so that they cannot be easily seen through the small gaps between panels. The radial arms can be identical to each other for holding any one of the identical OLED cassettes. However, the use of a spider bracket having differently sized or configured radial arms for holding differently sized or configured OLED cassettes is considered within the scope of the invention.

Figure 10:
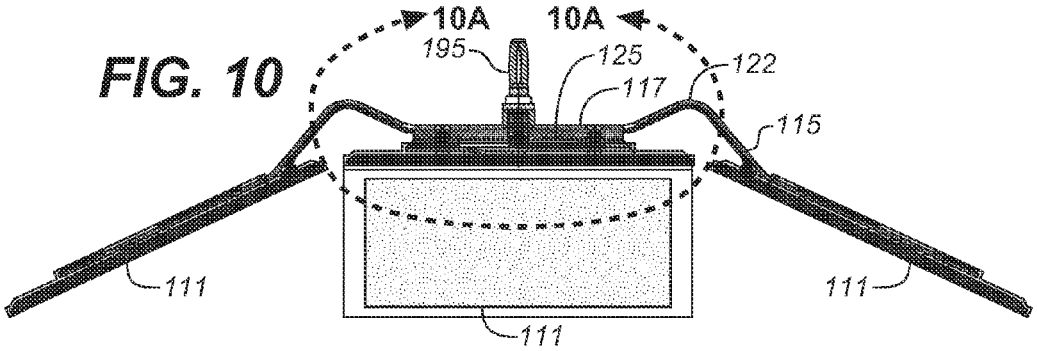
FIG. 10 is a cross-sectional view thereof taken along lines 10-10 in FIG. 9.
Figure 11:
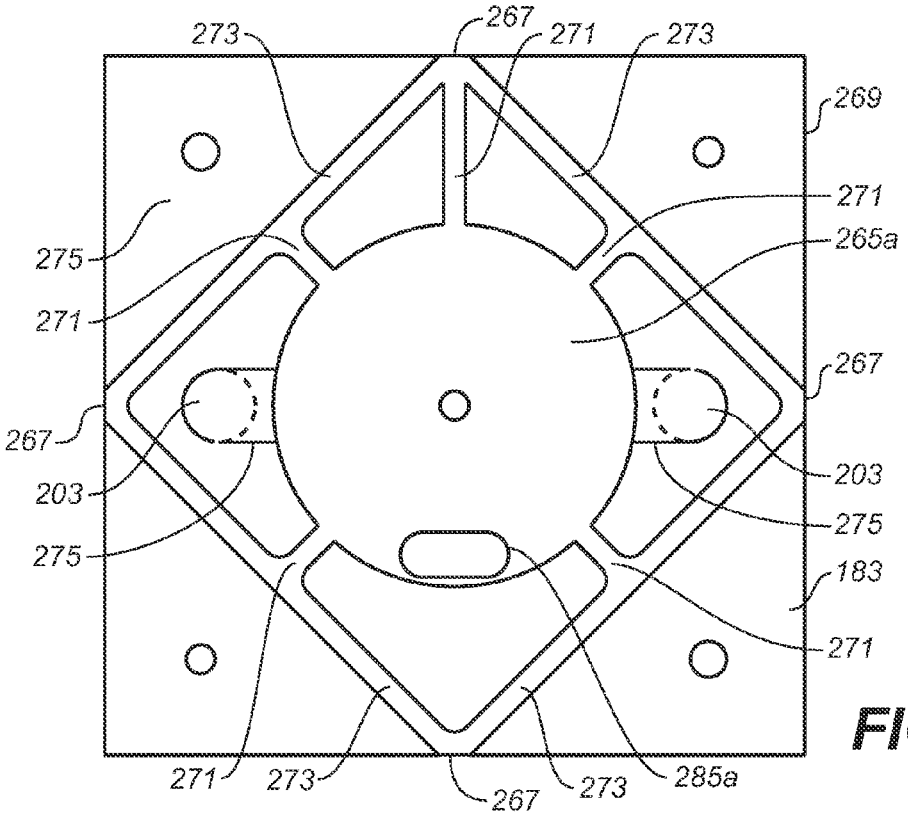
FIG. 11 is a bottom plan view of the top plate of the unique wire management block of the light module seen in FIGS. 10-10C.
Figure 12:
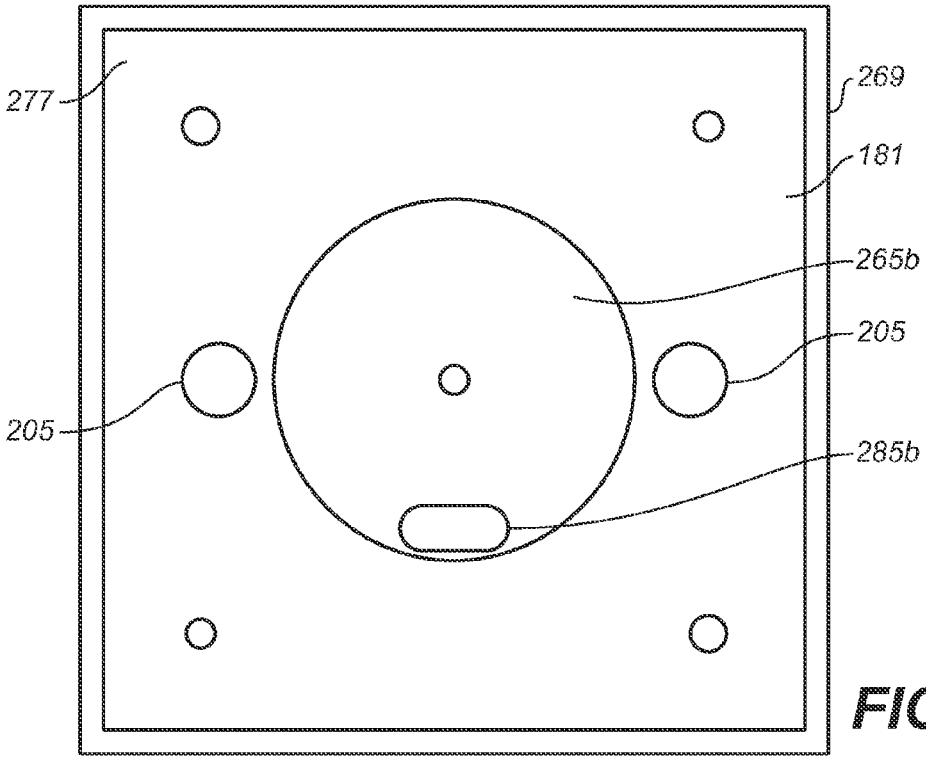
FIG. 12 is a bottom plan view of the base plate of the wire management block of the light module.

As best seen in FIGS. 10-12, the center OLED cassette 113 can be attached to the underside of the center hub section 117 of the spider bracket. A wire management block 125 sandwiched between the bracket's center hub section and the top of the center OLED cassette provides a means of attachment. It also provides a unique wire organizing function for wiring together the five OLED panels as hereinafter described. Before describing the wire management block and the attachment of the center OLED cassette to the spider bracket, the OLED cassettes will first be described in greater detail.

Figure 15:
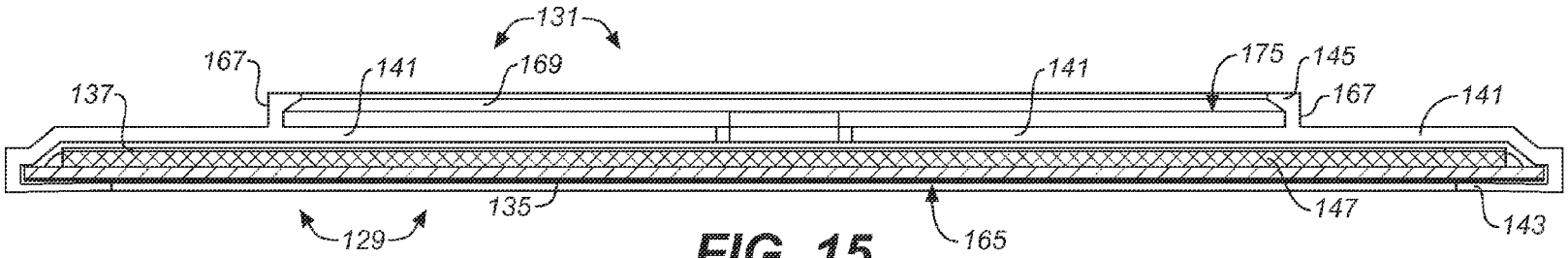
FIG. 15 is a cross-sectional view of the OLED cassette frame only taken along lines 15-15 in FIG. 14C.
Figure 16:
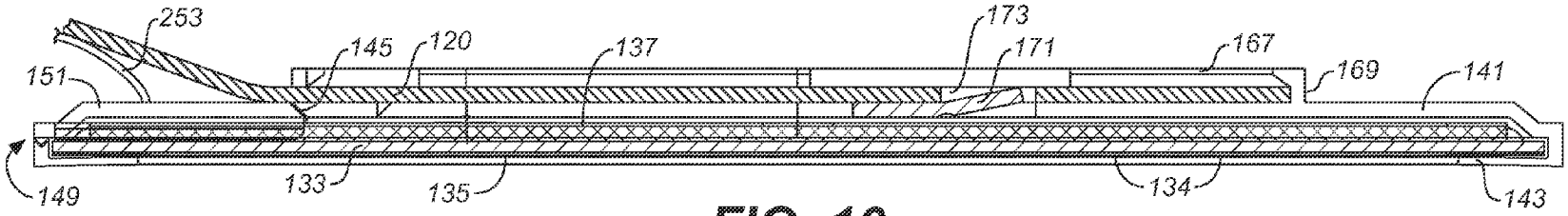
FIG. 16 is a cross-sectional view of the OLED cassette, including the OLED panel, taken along lines 16-16 in FIG. 14C.

As above mentioned, the OLED cassettes 111, 113 of the illustrated light modules 15, 17 are substantially identical so that they can be interchanged one for the other at any position within the light module. As best seen in FIGS. 14-16, each of these universal OLED cassettes is comprised of a thin, substantially planar cassette frame 127 having a bottom side 129 and a top side 131, and is loaded with a planar OLED panel 133 having a front side 135 and a back side 137. The back side of the OLED panel supports an electrical interconnection means for the OLED, preferably in the form of low profile side entry connectors 139, 140. (The electrical interconnections and unique placement of the electrical interconnection means are described in more detail below.) The bottom side of the cassette frame includes OLED panel retention means that permit the OLED panel 133 to be retained by the cassette frame so that the light emitting surface 134 on the front side of the panel is exposed for emitting light from the bottom of the cassette. The top side 131 of the cassette frame has a further retention means, in this case spider bracket retention means, that permits the OLED cassette to be retained on one of the radial arms of the spider bracket or alternatively to the underside of the center section of the spider bracket.

In the illustrated embodiment, the OLED panel retention means of the cassette frame includes a base wall 141 and a bottom perimeter rim 143 that extends beyond a front edge 145 of the base wall. The base wall and perimeter rim form a slide channel 147 in the bottom side of the cassette frame. The bottom slide channel has an open front extending end 149 formed between the front edge 145 of the base wall and the front edge 146 of the frame's bottom perimeter rim 143.

Figure 14A:
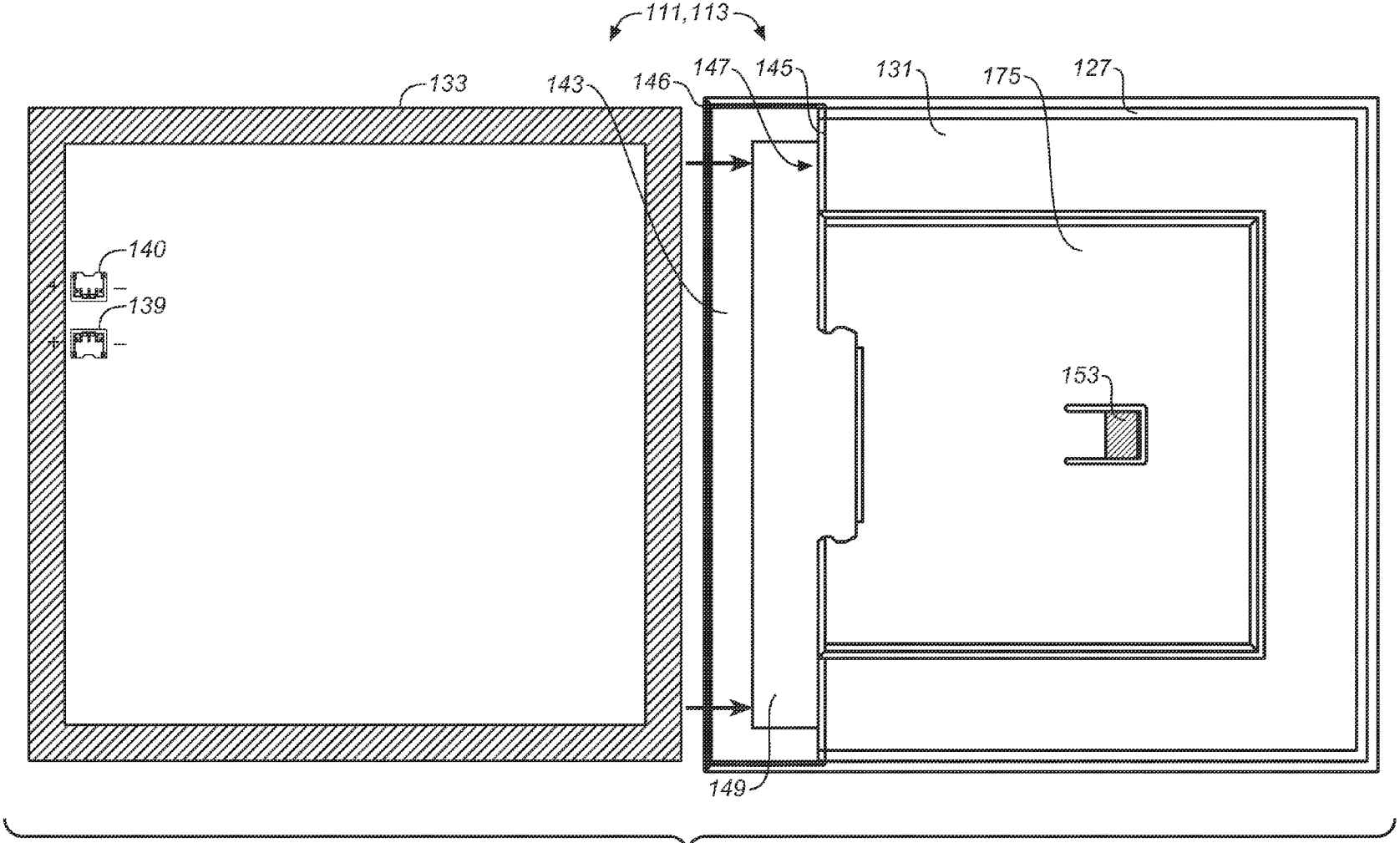
FIG. 14A is an exploded top plan view of an OLED panel and the cassette frame of a unique OLED cassette for use with the light module illustrated in the foregoing figures, showing an OLED panel being inserted into the front loading end of the cassette frame.
Figure 14B:
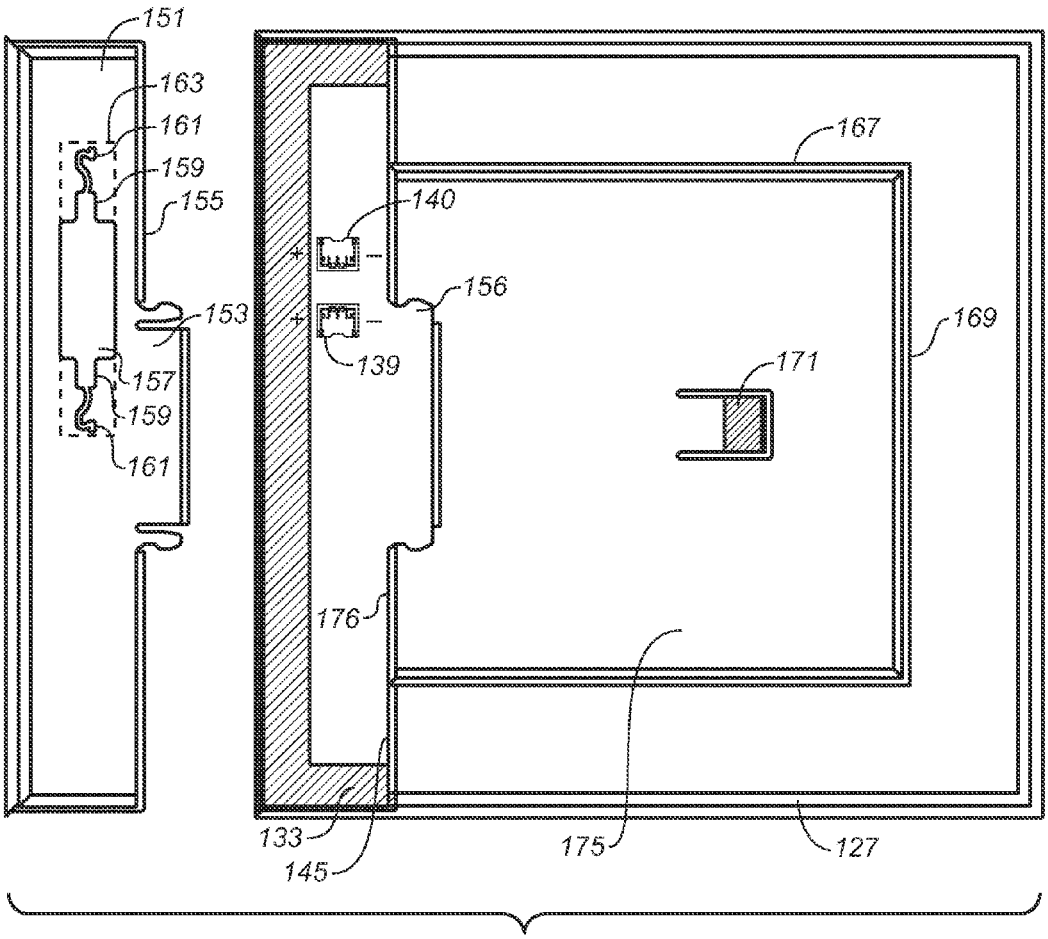
FIG. 14B is a top plan view of the OLED cassette with the OLED panel inserted into the cassette frame and an edge cover strip for the cassette frame exploded away from the cassette.
Figure 14C:
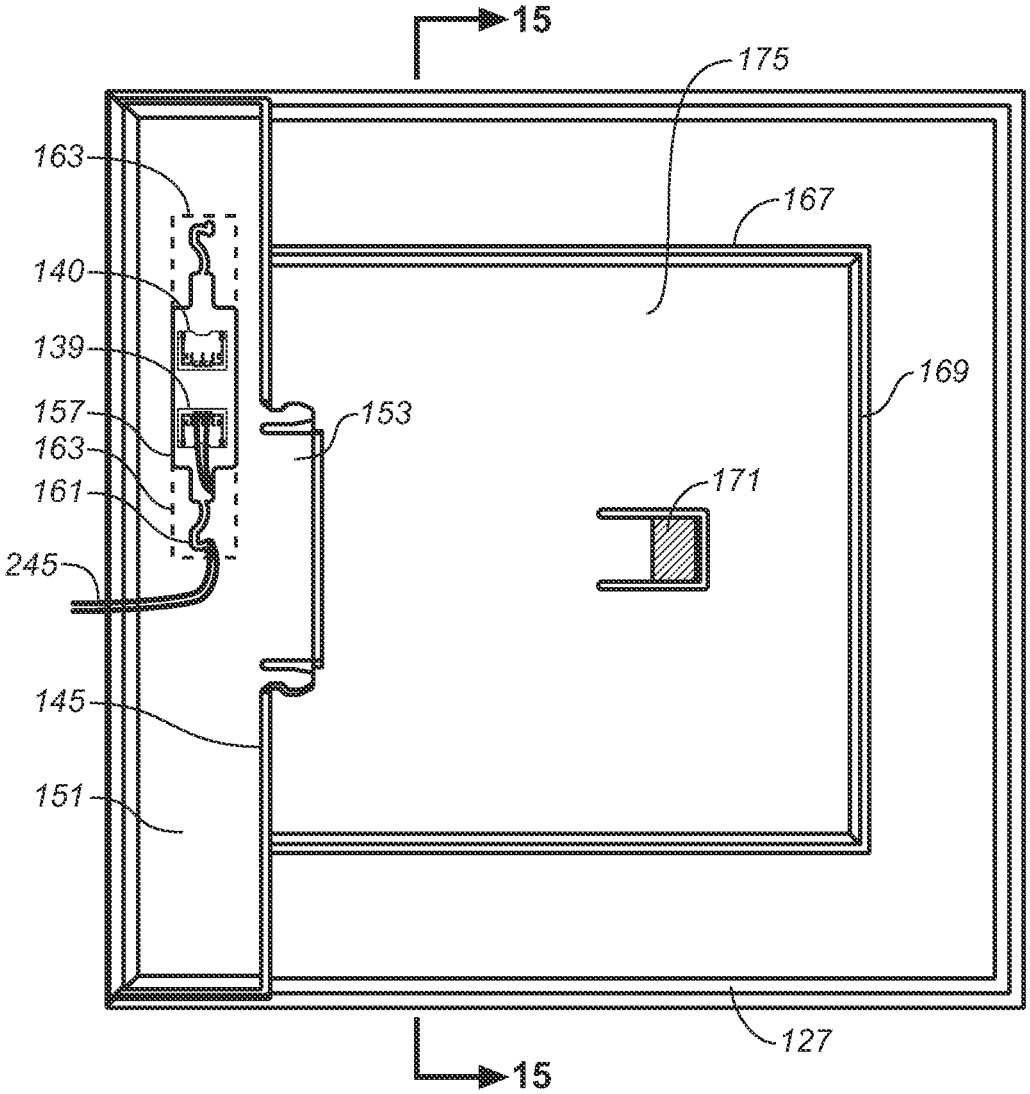
FIG. 14C is a top perspective view of the OLED cassette shown in FIGS. 14A and 14B fully assembled.

As illustrated in FIGS. 14A and 14B, the OLED panel 133 can be inserted into the bottom slide channel of the cassette frame by sliding it through the open front loading end of the cassette frame. Once the OLED panel is inserted, the front loading end of the cassette frame and the top exposed edge of the OLED panel—the edge that extends beyond the base wall's front edge 145—can be covered by cover strip 151. The cover strip has a snap-lock projection 153 on its leading edge 155 that fits and locks within a corresponding snap-lock recess 156 in the front edge of the base wall. It further includes a wire interconnector access opening 157 located such that the access opening lies over the interconnectors 139, 140 on the back of the OLED panel when the cover strip is inserted onto the frame. Access opening 157 is seen to include first narrow extensions slots 159 at its ends and further irregular and narrower slot extensions 161. As later described, lead wire pairs having male side entry connectors for connecting to one of the interconnectors on the back of the OLED panel can be cinched into the narrower irregular extension slots to keep the lead wires in place and to help maintain the organization of the lead wires within the light module.

As indicated by dashed lines 163, recesses can be provided on the undersurface of the cover strip surrounding the extension slots to accommodate the short sections of wire that run beneath the cover strip and thin contactor pads on the back of the OLED. It is noted that all OLED wire connections and connectors are positioned entirely within the foot print of the OLED cassette thereby preventing any protrusions from the edge of the cassette that might interfere with adjacent cassettes or distract from the clean lines and aesthetic appearance of the cassette.

The bottom perimeter rim 143 of the cassette frame defines the overall size and shape of the cassette frame and hence of the OLED cassette, which, as above-mentioned, suitably can be about four inches square. The cassette frame's perimeter rim also provides a bottom opening 165 in the frame sized in correspondence with the light emitting surface 134 of OLED panel 133.

It is noted that opening and closure of the OLED cassette frame for inserting an OLED panel could be accomplished by means other than the use of a separate cover strip as above described. For example, a flat flexible hinge could be used to open and close the bottom of the cassette for insertion and removal of the OLED cassette.

The spider bracket retention means of the cassette frame can be provided on top of the frame's base wall 141. As best seen in FIG. 15, this retention means is comprised of slide pocket 175 formed by parallel slide rails 167 and a back rail 169. A spring locking tab 171 projects up from the base wall and depresses when the flat connector plate 120 at the end of one of the radial arms of the spider bracket is slid over the tab. Each of the bracket's flat connector plates has a locking slot 173 positioned such that the spring tab 171 snaps into the locking slot, and thereby locks the bracket connector plate in place on top of the cassette frame when the connector plate is inserted all the way into the slide pocket 175. The connector plate can be released from the slide pocket by pressing down on the locking tab and sliding the connector plate out of the open front end 176 of the slide pocket.

Figure 10A:
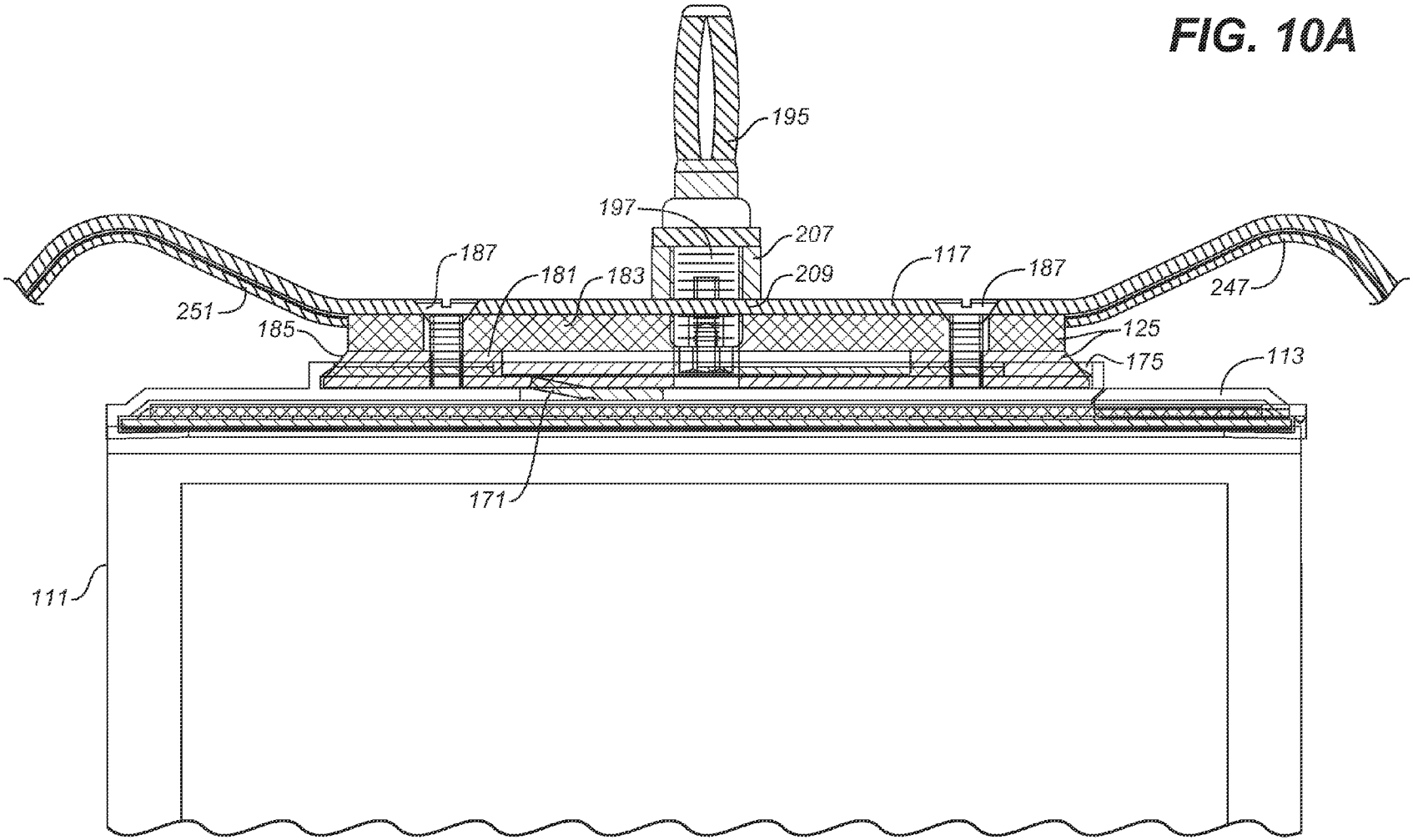
FIG. 10A is an enlarged fragmentary cross-sectional view thereof as indicated by dashed line 10A in FIG. 10.
Figure 10B:
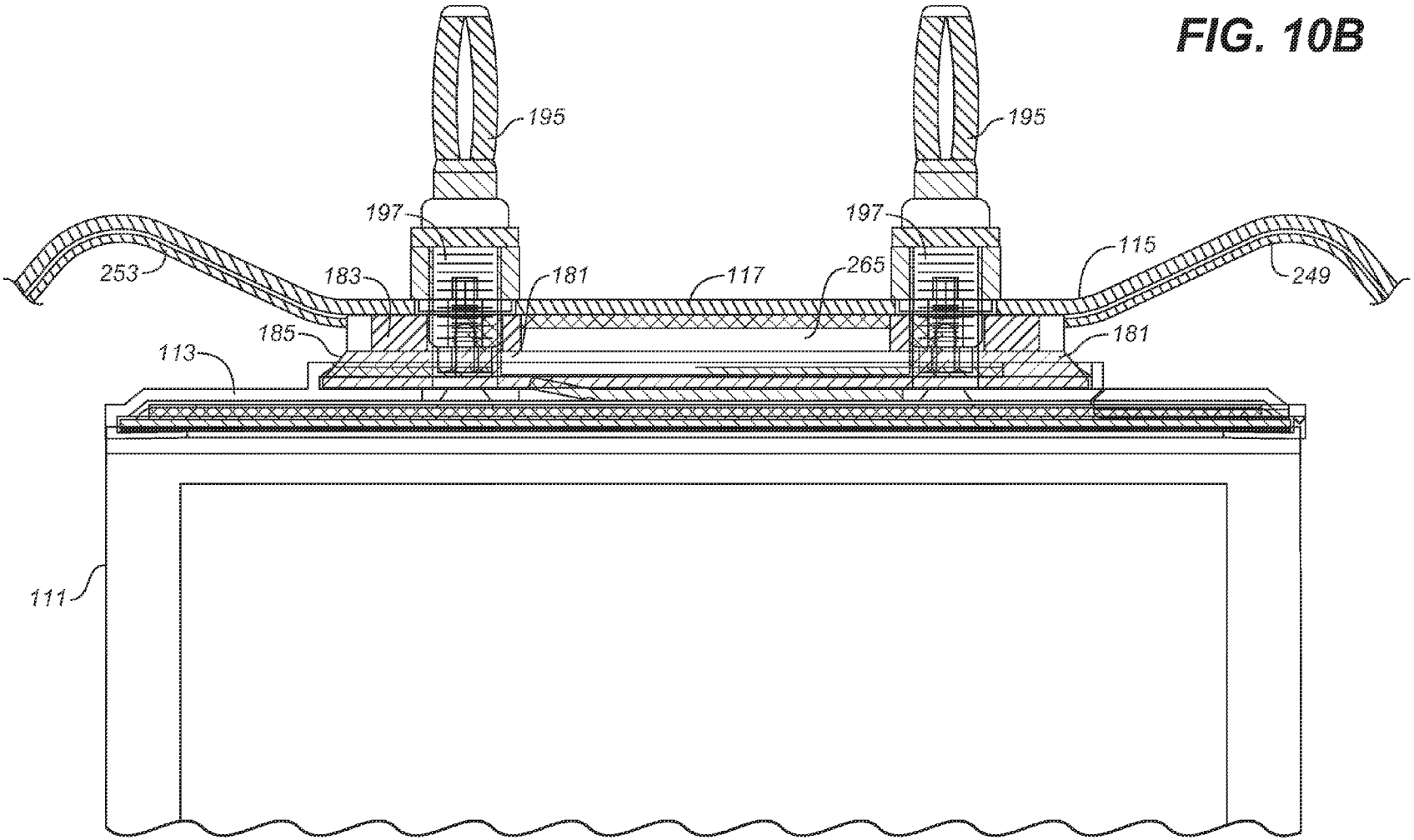
FIG. 10B is another enlarged fragmentary cross-sectional view thereof taken along section lines 10B-10B in FIG. 9.
Figure 10C:
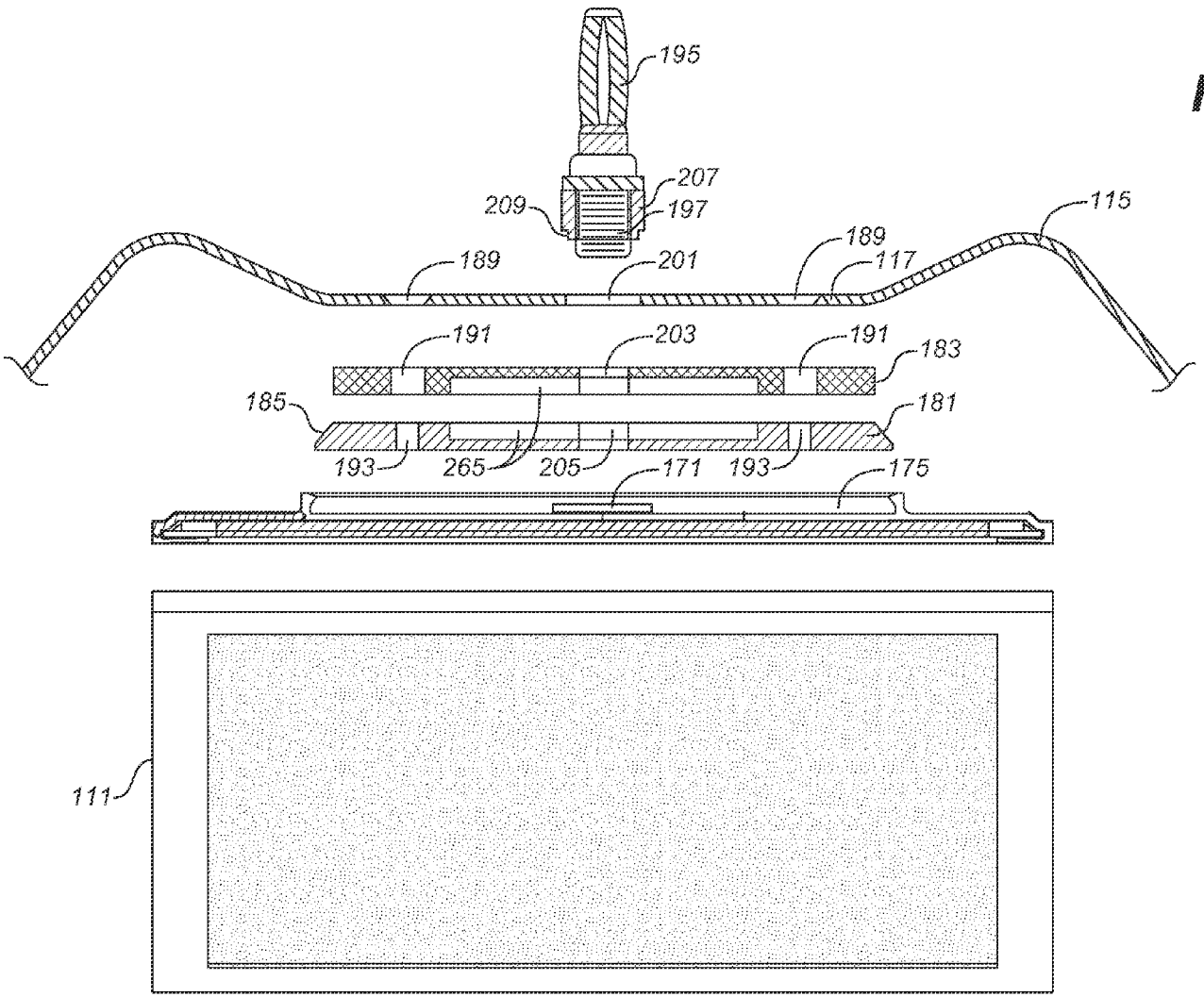
FIG. 10C is an enlarged exploded cross-sectional view thereof.

Alternatively, the slide pocket 175 on the top or back of the OLED cassette frame can be used as retention means for the wire management block 125, which in turn can be used to attach center OLED cassette 113 to the underside of the center hub section 117 of the spider bracket 115. As best seen in FIGS. 10A-10C, wire management block 125 is comprised of a base plate 181 and a top plate 183. The base plate is provided with extending side edges, here in the form of angled edges 185, which allow the base plate to be slid into and held by the side and back rails of the slide pocket 175 on the top of the cassette frame, that is, by the same slide pocket used to hold the radial arms of the spider bracket 115. The screw fasteners 187 can be inserted through lag holes 189, 191 in, respectively, the spider bracket and the top plate of the wire management block, and screwed into threaded holes 193 in the management block's base plate to secure the wire management block to the underside of the center section of the spider bracket. This will hold the center OLED cassette 113 retained by the base plate to the underside of the spider bracket.

Banana plugs 195 having threaded bases 197 can be mounted to the top of the center hub section of the spider bracket by screwing the threaded bases 197 of the banana plugs into the wire management block through banana plug mounting holes 201 provided in the bracket's center section. The threaded bases of the banana plugs can be screwed directly into the top plate 183 of the wire management block, which can be provided with suitably spaced apart threaded holes 203 for this purpose. (Corresponding holes or recesses 205 can be provided in the base plate 181 to accommodate any portion of the bases of the banana plugs that project below the bottom of the top plate.) As best seen in FIGS. 10A and 10B, the threaded base of each banana plug is surrounded by an insulating collar 207, which seats against the top of the center section of the spider bracket. This insulating collar, which is suitably made of PVC plastic, has a reduced diameter end projection 209 that fits within the mounting holes for the banana plugs to electrically insulate the bases of the banana plugs from the spider bracket.

Figure 13:
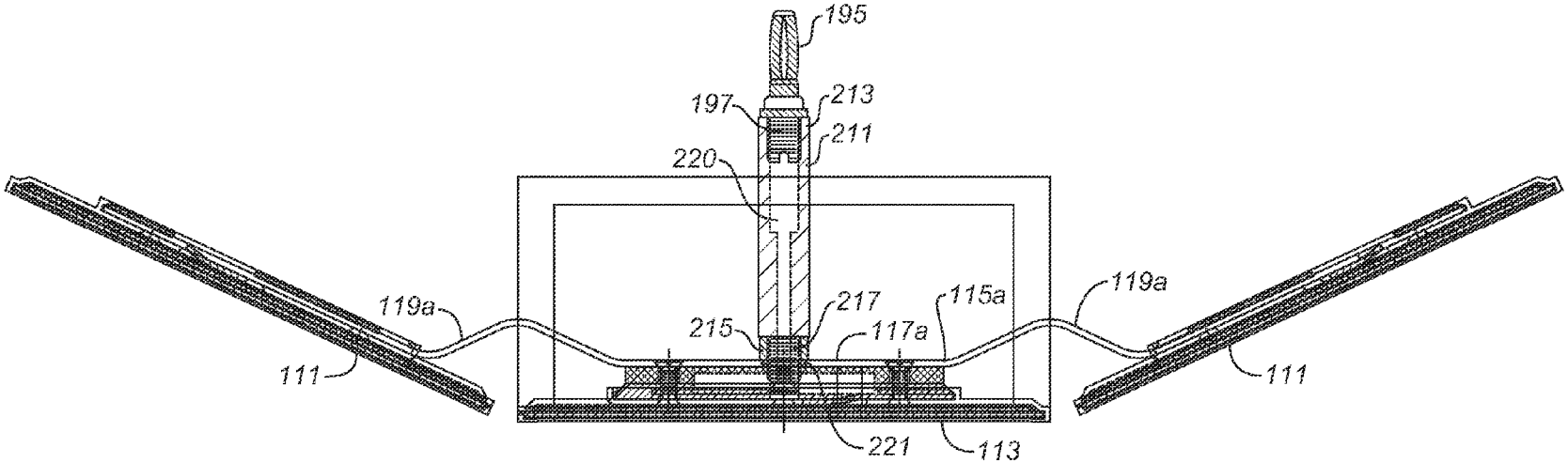
FIG. 13 is a cross-sectional view of another version of a light module that can be used in a configurable ceiling lighting system in accordance with the invention alone or in combination with other versions of the light module.

FIG. 13 shows in greater detail the alternative light module 17 having OLED cassettes 111, 113, constructed as above-described, connected to a spider bracket 115*a* having radial arms 119*a* that are bent up from its center hub section 117*a* instead of being bent down as in the case of light module 15. (Again, the angle of the arms relative to the center hub section of the spider bracket is suitably about 25 degrees.) Providing this arm-up version in addition to the arm-down version of the light module allows for the interspersing of light modules on driver panels, such as the above-described driver panels 13, in a tight cluster without interference between the outboard OLED cassettes of the light modules. Due to its arm-up configuration, the banana plugs 195 for light module light module 17 are mounted to banana plug extensions 211 having a top end 213 into which the bases 197 of the banana plugs can be connected, and a bottom end 215 in which secondary threaded base electrodes 217 can be provided. The body 219 of the extension includes an internal passageway 220 for a conductor (not shown) that connects the base of the banana plug to the secondary base electrode. It also provides a reduced diameter end projection 221, which, like the end projection 209 on the insulating collar 207 used on the arm-down version, fits within the mounting holes for the banana plugs.

The banana plugs 195 on top of the light module 15, 17 provide a means for electrically connecting the light modules 15, 17 to driver panels 13 placed within a grid ceiling. Banana plugs are preferably selected having an extraction force sufficient to hold the lightweight light modules in place once they are plugged in. Additional mechanical connections may be provided, such as a short tie wire (not shown) connected between the top of the spider bracket of the light module and the driver panel into which it is plugged.

It will be understood that electrically and mechanically connecting the light modules to driver panels by means other than the illustrated banana plugs and banana plug sockets is considered within the scope of the invention. For example, a twist connector might be used that combines an electrical connection and a positive mechanical connection when the connection is made.

Figure 17:
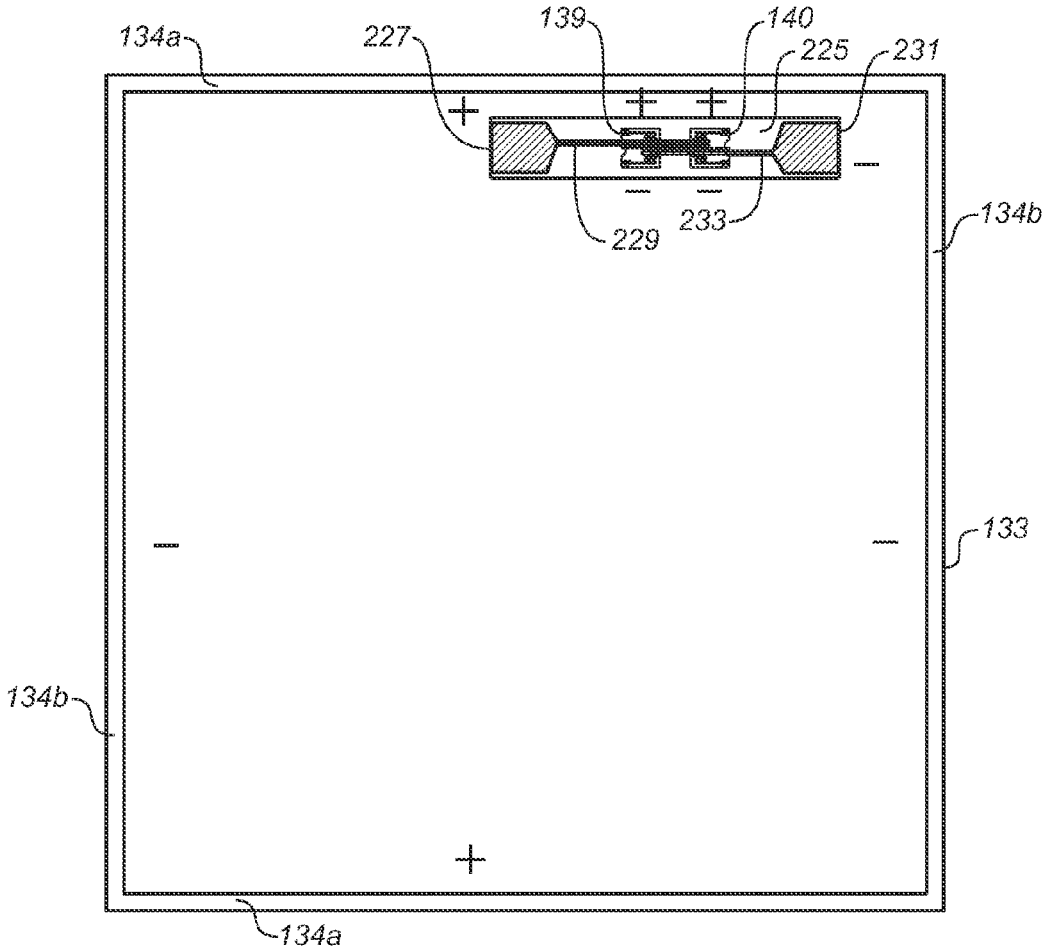
FIG. 17 is a top plan view of an OLED panel that is inserted into the cassette frame of the OLED cassette, showing interconnectors on the back of the OLED panel.
Figure 18:
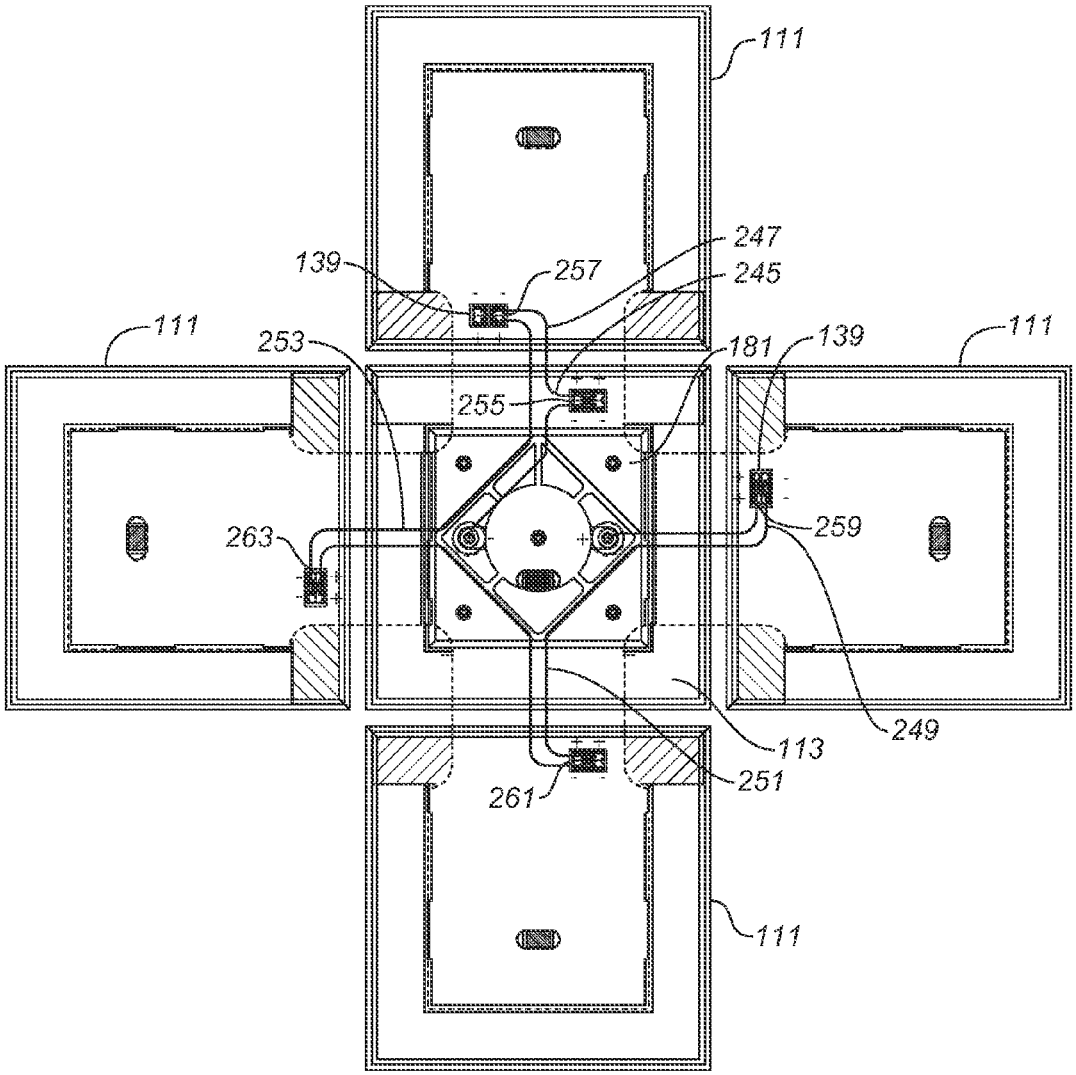
FIG. 18 is another top plan view of the light module illustrated in the foregoing figures showing wire organization and connections for OLED cassettes of the light module.
Figure 19:
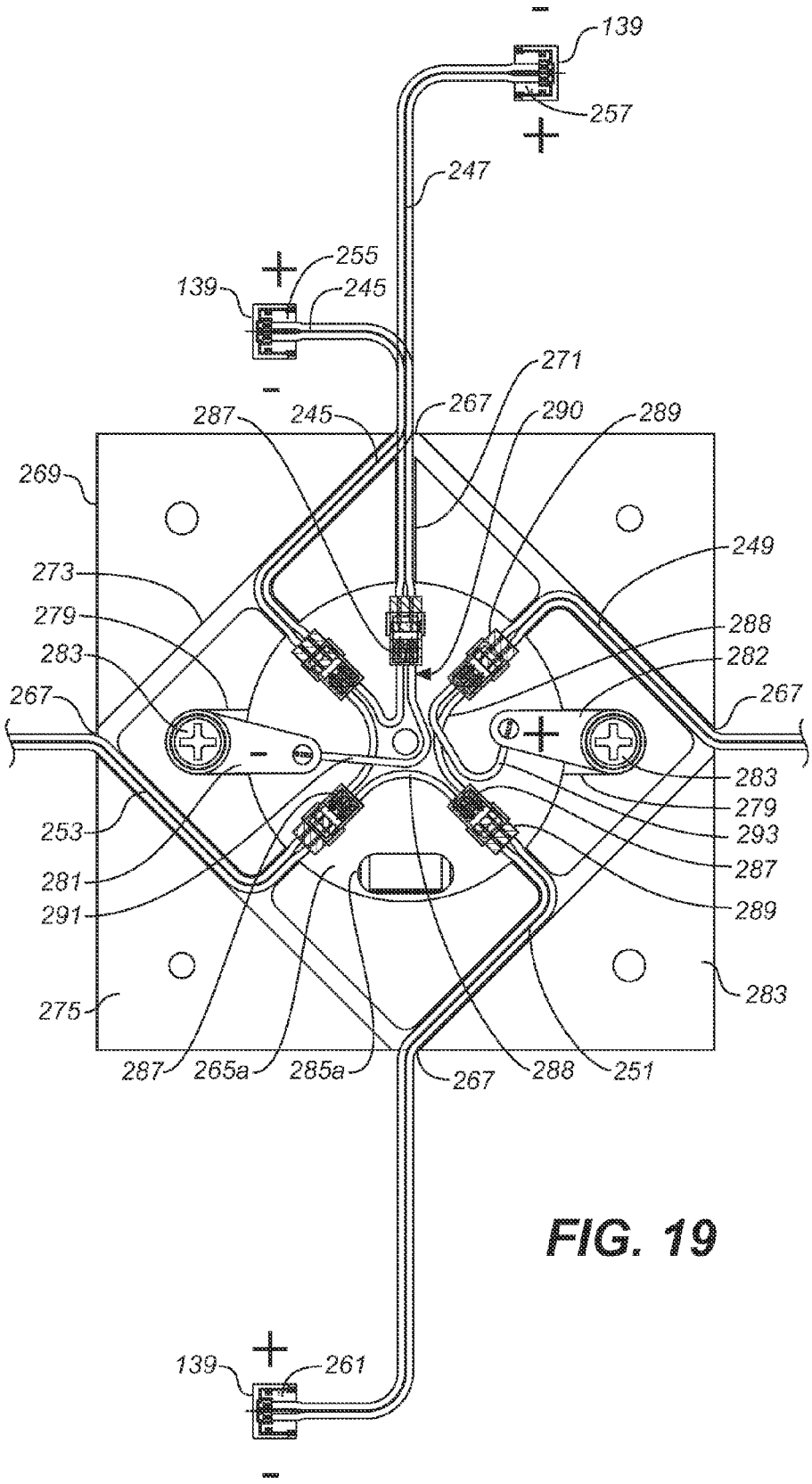
FIG. 19 is another bottom plan view of the top plate of the wire management block of the light module showing in more detail the wire organizing features thereof.
Figure 20:
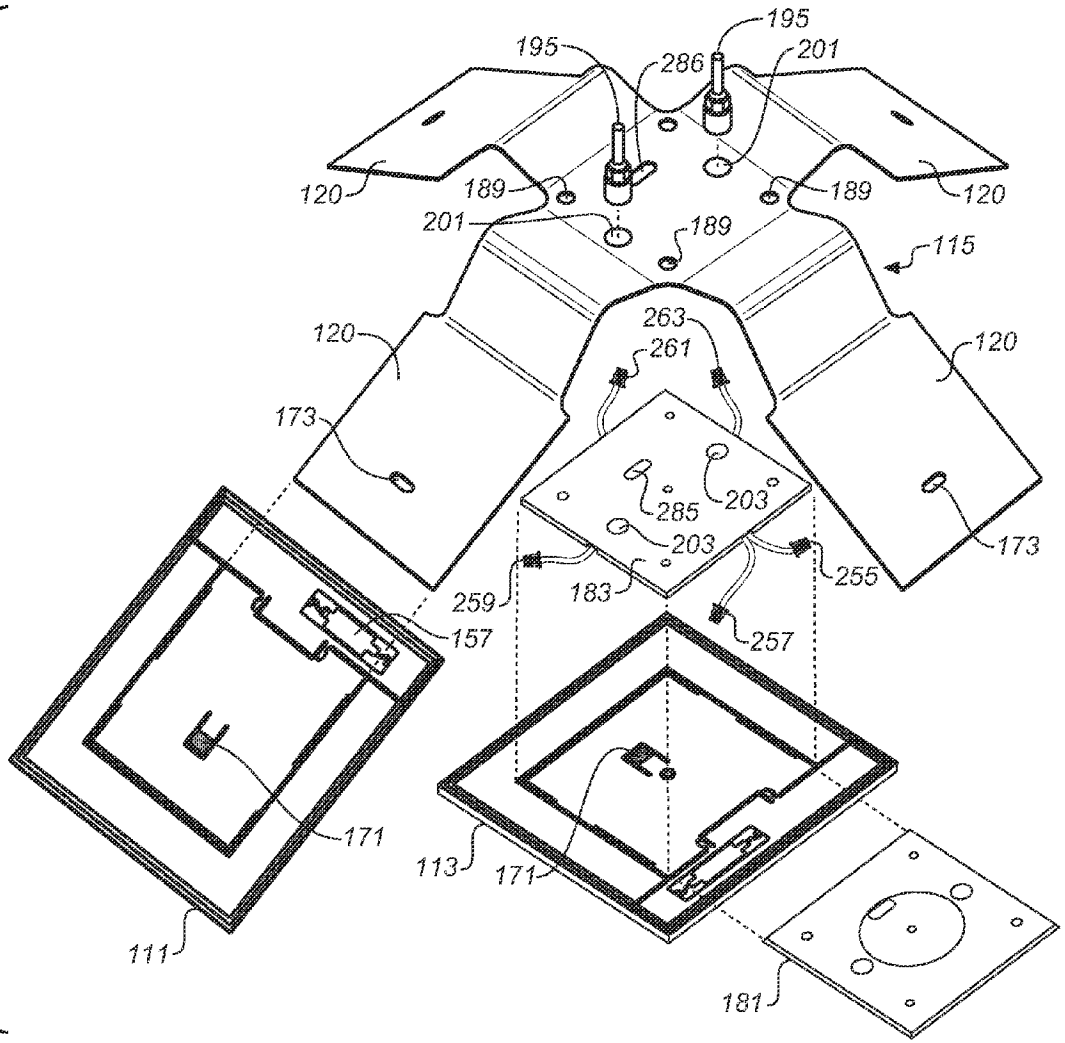
FIG. 20 is an exploded perspective view of the light module illustrated in the forgoing drawings, showing among other things the spider bracket, one of the four outboard OLED cassettes only, the center cassette, and the wire management block.

FIGS. 17-19 illustrate an electrical design and wiring scheme for the light modules used for the OLED cassettes above-described. FIG. 20 is an exploded view of the light module 15 which further illustrates the assembly of the light module and the wiring for the module's OLED cassettes 111, 113.

FIG. 17 shows the back of the OLED panel 133 and particularly the advantageous location of the electrical connectors inside the panel's perimeter. The OLED panel typically has opposed positive perimeter edges 134*a* and opposed negative perimeter edges 134*b*. The OLED panel will be energized, or "turned on," when the positive and negative sides of a threshold voltage are applied to these respective edges. The threshold voltage is supplied through the electrical connectors 139, 140, which are advantageously mounted inside of one of the perimeter edges of the OLED panel. The connectors, suitably side-entry ACH connectors, are mounted to a thin dielectric mounting strip 225 adhered to the back surface of the panel. A positive conductor plate 227 is fixed to one end of the mounting strip and is connected to the positive sides of the connectors by conductor path 229, and a negative conductor plate 231 is fixed to the other end of the mounting strip and is connected to the negative sides of the connectors by conductor path 233. One or more ribbon conductors (not shown) can be provided on the back of the panel to place the positive perimeter edges 134*a* of the panel in electrical contact with the positive conductor plate 227, and to place the negative perimeter edges 134*b* in electrical contact with the negative conductor plate 227. All of the conductor and insulator elements can be relatively flat and fit within the OLED cassette frame, and can be electrically isolated from one another where they cross.

The wiring of the light modules 15, 17, and the unique organization of the wire leads within the modules is now described in reference to FIGS. 18-20. In the illustrated light modules the OLED panels of the OLED cassettes 111, 113 are connected in series. Because of this, only one of the OLED connectors, connector 139, is used. The OLED cassettes can also be connected in parallel, in which case both of the connectors 139, 140 would be used.

The wiring of the OLED panels of the illustrated OLED cassettes requires that pairs of lead wires 245, 247, 249, 251, 253 be available for connection to the chosen connector (e.g. connector 139) of each OLED panel 133 of each OLED cassette, namely, of each of the outboard OLED cassettes 111 and of center OLED cassette 113. Each pair of lead wires has a terminal end 255, 257, 259, 261, 263 having a connector that fits into the chosen connector on the OLED panel of an OLED cassette, and each wire of any one of the wire pairs is connected to a wire of a wire pair for another OLED cassette to create a series connection between OLED cassettes. These connecting up of wires along with the containment of the wires can be accomplished within a small space within the center wire management block 125 used to mount the center OLED cassette to the spider bracket.

The wire, or more broadly the conductor organizing functions of the wire management block, can be achieved by providing in the block a central hub cavity 265 (see FIG. 10B) and wire organizing channels which are in communication with the central hub cavity and which carry wires from the hub cavity to wire exit points 267 at the edge walls 269 of the wire management block. Referring to FIGS. 11, 12 and 19, the wire organizing channels can include radial spoke channels 271 that are in communication with a rim channel 273, which is in communication with the wire exit points 267. The spoke channels carry wires from the hub cavity to the rim channel, and the rim channel feeds wires to the wire exit points of the block, all in an organized way that is further described below.

As earlier described, the wire management block can be fabricated in two halves, namely, with a base plate 181 and a top plate 183. The central hub cavity is formed internally within the block by providing opposed, suitably cylindrical recesses 265*a* and 265*b* on the interior faces 275 and 277 of, respectively, the management block's top plate and bottom plate. These two opposed recesses combine to provide suitable depth to the center hub cavity for accommodating a bundle of wires and wire connectors. The wire organizing channels 271, 273 on the other hand can be shallower than the center hub cavity. Consequently, these channels need only to be provided in one of the interior faces of the two plates of the of the wire management block. In the illustrated embodiment, the wire organizing channels are seen to be provided in the face 275 of the top plate 183.

The two plates of the wire management block are suitably fabricated of a polyvinyl chloride (PVC) plastic. PVC plastic offers light weight, desired electrical insulation properties, and strength. The recesses for the center hub cavity and wire organizing channels can be routed into the faces of the PVC blocks or created by other well known manufacturing techniques. Additional recesses 279 can be provided in the interior face 275 of the top plate 183, which extend from the banana plug base holes 203 to the center hub cavity. As seen in FIG. 19, these recesses accommodate the negative and positive conductor plates 281, 282 attached to the bottom of the base of the banana plugs. These attachments are made after the banana plugs are installed (as described above) by means of screw fasteners 283. Matching slots 285*a*, 285*b* in the top and base plates provide an access slot through the wire management block that aligns with a similar slot 286 in the center section of the spider bracket. These slots line up with the spring tab 171 in the base wall 141 of a cassette frame 127 for an OLED cassette, and permit a tool, such as a screwdriver, to be inserted to push the tab down to release the wire management block from the cassette frame.

FIG. 19 best shows the wire connections and organization within the wire management block 125. The wire management block routes the lead wire pairs 245, 247, 249, 251, 253 economically within the block from the central hub cavity 165 through the radial and rim channels and out the exit points 267 at block edge walls 269. A connector web 290 is provided in the center hub cavity for connecting up the lead wire pairs and for establishing a connection to electrical power supplied through the banana plugs. The connector web includes small connectors, such as ACH end entry or side entry connectors 287, one for each of the OLED cassettes. Short connecting wires 288 wire the connectors 287 together in series and to the negative and positive bottom conductor plates 281, 282 for the banana plugs. Each of the lead wire pairs 245, 247, 249, 251, 253 has an interior connector 289 to allow the lead wire pairs to be connected to the connector web within the hub cavity before assembly of the plates of the wire management block.

It is contemplated that the wire management block can be provided in the form of the printed circuit board wherein the "wires" within the block are conductor paths of the printed circuit board. Using a printed circuit board, the interior connectors 289 can be eliminated. Connectors, such as side entry connectors, could be provided at the midpoints of the perimeter edges of the management block (where the wire exit 267 are located), to allow lead wires to be connected to the edges of the block. The conductor paths of the printed circuit board would provide the same conductive paths as the wires shown in FIG. 19. Internal connector pads could be provided which would be contacted by or otherwise electrically connected to the bases 197 of the banana plugs.

Assembly of either of the illustrated arm-down or arm-up light modules 15, 17 is essentially the same. With reference to FIGS. 10C and 18-20, wire management block 125 and center OLED cassette 113, loaded with an OLED panel, can be attached to the spider bracket 115. This can be done by first sliding the base plate 181 into the slide pocket 175 of the cassette frame of one of the OLED cassettes—which becomes the center OLED cassette 113—until the base plate snaps into place on the spring locking tab 171 on the back of the base wall of the OLED cassette frame. The top plate 183 of the wire management block can separately be mounted to the underside of the center hub section of the spider bracket by screwing the threaded bases of the banana plugs 195 into the threaded holes 203 in the top plate. The connector web can then be installed in the recess 265*a* in the bottom of the top plate by fixing the negative and positive lead wires 291, 293 for the connector web to, respectively, the banana plug negative and positive conductor plates 281, 282. This can be accomplished by screwing the conductor plates 281, 282 down onto the connector web lead wires by screw fasteners 283. The cassette lead wire pairs 245, 247, 249, 251, 253 can then be connected to the connector web and pressed into the wire organizing channels 267, 269 so that, except for the cassette lead wire pair for the center OLED cassette, a different cassette lead wire pair emerges from a different wire exit point 267 at a different edge wall 269 of the wire management block. The lead wire pair 245 for the center OLED cassette can emerge from the same wire exit point as one of the other cassette lead wire pairs, preferably on the edge closest tp the wire interconnector access opening 157 in the edge cover plate 151 of the cassette frame of the center OLED cassette.

The center OLED cassette can then be attached to the underside of the spider bracket by placing the captured bottom plate of the wire management block against and attaching it to the top plate attached to the spider bracket, thereby capturing the connector web and interior ends to the cassette lead wires in wire management block. The outboard OLED connectors, each loaded with an OLED panel, can then be inserted onto the connector plates 120 of the radial arms of the spider bracket until they snap into place on the cassette frames spring tabs. The ends to the cassette lead wire pairs extending from the wire management block can then be connected to the wire interconnectors 139 mounted to the back of the OLED panels through the wire interconnector access openings 157 in cassette frames. Preferably the cassette lead wire pairs will have a length that allows the wires to be pushed up out of view against the upward projecting arch 122 of the bent extension 121 of the brackets' radial arms, with little if any excess wire existing between the wire management block and the OLED cassettes. Cinching of the wire in the narrow irregular slot extensions 161 of the cassette frame's wire interconnector access openings will keep the lead wires centered and prevent them from poking out of the access opening in an unsightly manner.

It will be appreciated that the order of assembly described above could be altered.

Removal of an OLED cassette to, for example, replace a damage or spent OLED panel can readily be accomplished by disconnecting the cassette lead wires from the panel and then removing the panel from the spider bracket by the release mechanism provided, in this case by the pressing the cassette frame's spring tab 171 through the provided access slots. In the case of the center OLED cassette, the outer cassette adjacent to the front 176 of the center cassette's slide pocket 175 can first be removed to allow the center cassette to be slid off to the base plate of the wire management block.

Figure 21A:
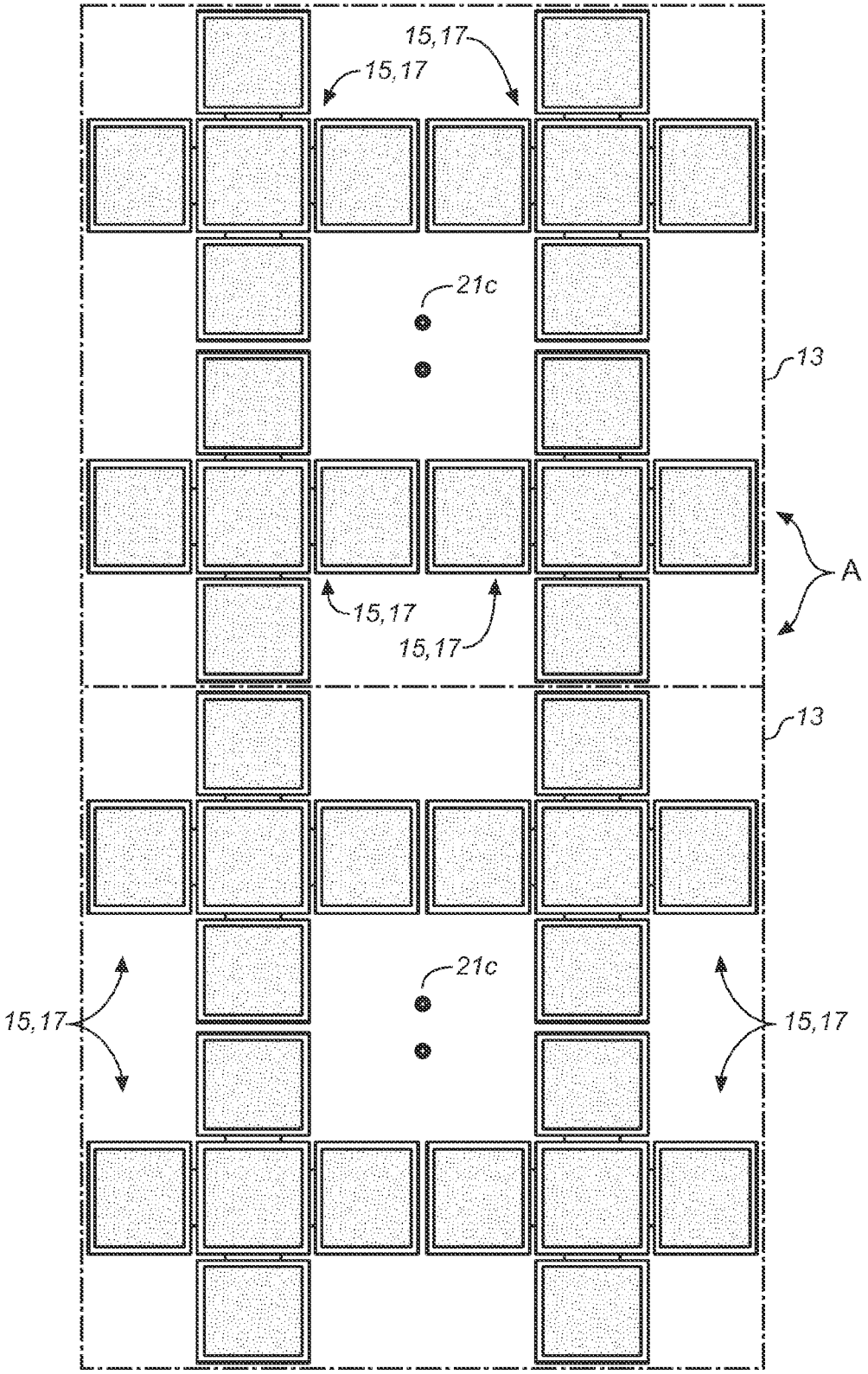
FIG. 21A shows one pattern of light modules on a grid ceiling that can be created with the driver panels and light modules illustrated in the foregoing figures.
Figure 21B:
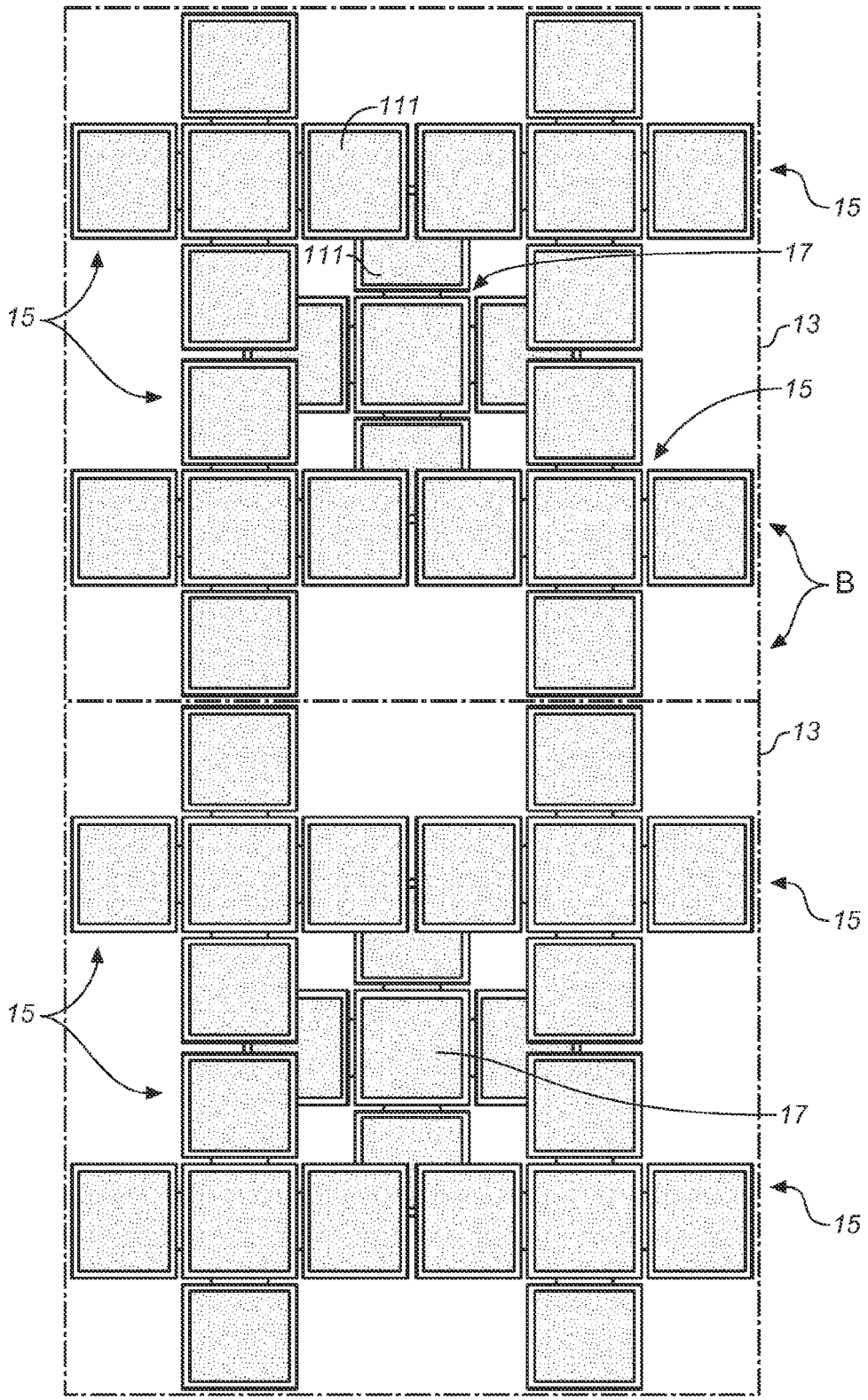
FIG. 21B shows another pattern of light modules on a grid ceiling that can be created with the driver panels and light modules illustrated in the foregoing figures.

FIGS. 21A-25 show examples of different driver panels that can be provided in accordance with the invention and different ceiling lighting system configurations that can be created using the OLED light modules above-described with the driver panels illustrated and described herein. In each case the connection points on the bottom of the panel are arrayed in the x-y pane of the panel to allow light modules such as those above-described to be arrayed on the panel in the x-y plane in desired groupings or clusters. FIG. 21A shows two side-by-side driver panels (represented by dashed lines 13) with the same array of five electrical connector means as the panel illustrated in FIG. 2 for providing five connection points on each panel. In the ceiling lighting system configuration shown in FIG. 21A, four five-panel light modules, either arm-down modules 15 or arm-up modules 17 or a combination thereof, are plugged into the four corner connection points of each driver panel to produce a layout of module cross rows denoted as layout "A". The center connector means 21*c* of each panel is unused and can be covered by finishing elements such as the cap plugs 91 shown in FIG. 1B. FIG. 21B shows the same side-by-side driver panels 13, but with five light modules plugged into each panel, that is, with a five-panel light modules plugged into each connection point on the panel, resulting in a cluster of modules denoted as layout "B." Here, the four corner light modules are suitably arm-down modules 15 with the center module being an arm-up light module 17. This will allow the outboard OLED cassettes of the center arm-up light module to fit under the outboard panel cassettes of the four corner light modules.

Figure 22:
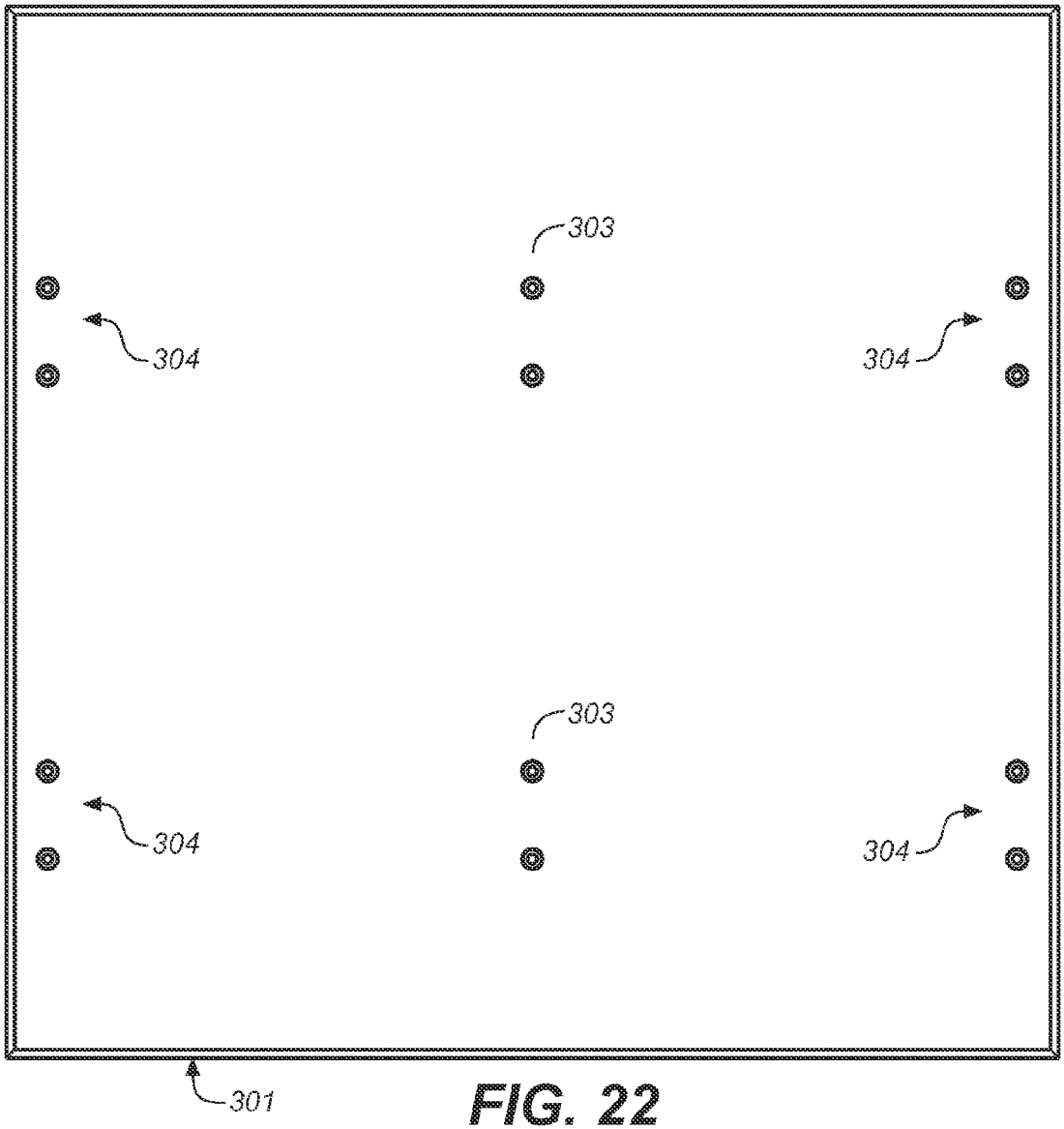
FIG. 22 is a bottom perspective view of a driver panel for a configurable ceiling lighting system in accordance with the invention showing an alternative configuration of the light module connector means in the bottom surface of the driver panel.
Figure 23:
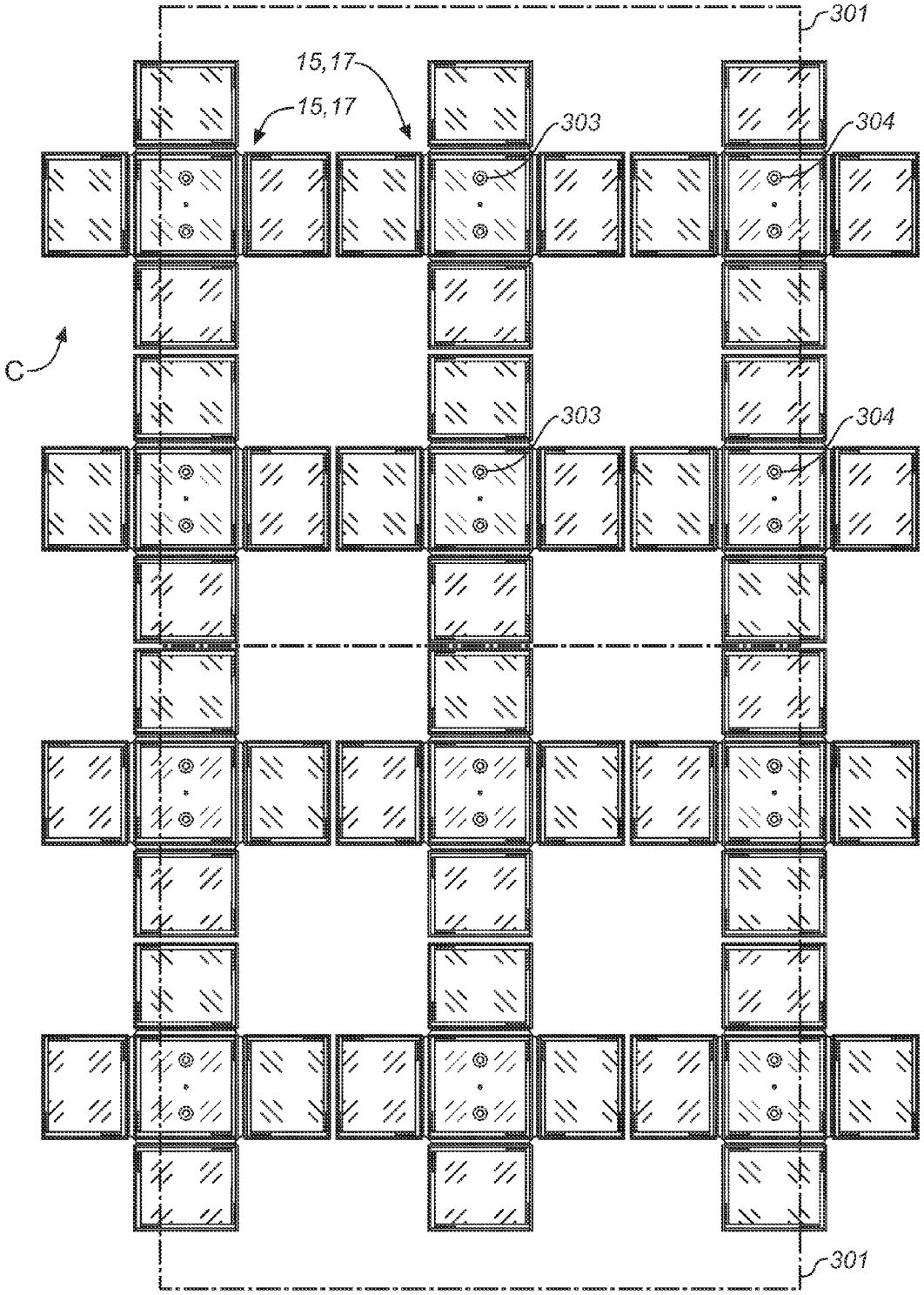
FIG. 23 shows a pattern of light modules on a grid ceiling that can be created with driver panels such as shown in FIG. 22.

FIG. 22 illustrates a driver panel 301 having a different arrangement of electrical connector means 303, 304 for providing different connection points on the panel. In this case six connection points are provided for up to six light modules. They include connection points at 304 closely adjacent to the perimeter edge of the driver panel to allow a light module to overlap ceiling grid panels. An example of a ceiling lighting system configuration that can be created with these driver panels is shown in FIG. 23, and is denoted as layout "C." The light panels plugged into the adjacent panels 301 can be either arm-up or arm-down versions of the light modules 15, 17 above described or a combination thereof.

Figure 24B:
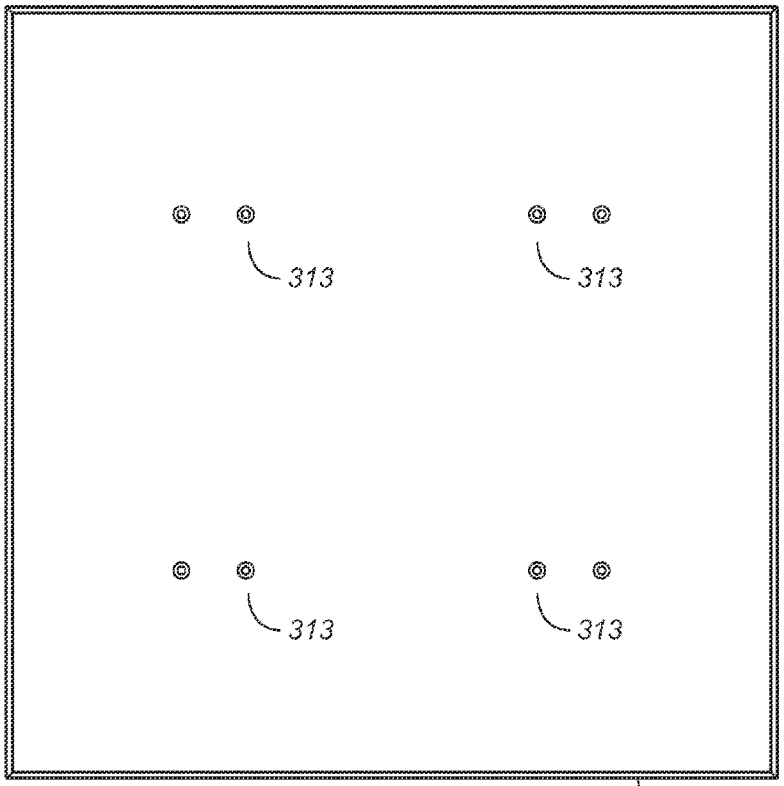
FIGS. 24A and 24B are bottom plan views of panel drivers in accordance with the invention showing yet further alternative configurations for the light module connector means provided in the bottom wall of the driver panel.
Figure 24A:
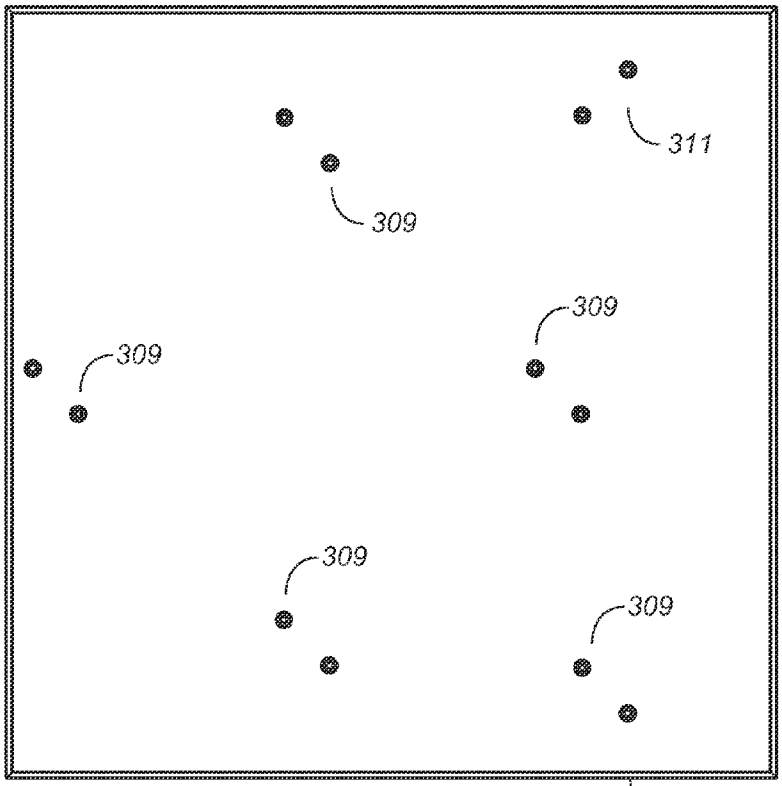

FIGS. 24A and 24B show driver panels 305, 307 with yet two further exemplary arrangements of electric connector means. In FIG. 24A the electrical connector means 309, 311 are angled relative to the perpendicular axes of the panel with one pair of connector means, connector means 311, being rotated ninety degrees relative to the other connector means 309. In FIG. 24B, the driver panel is shown with four connector means 313 oriented parallel to one perpendicular axis of the panel.

Figure 25:
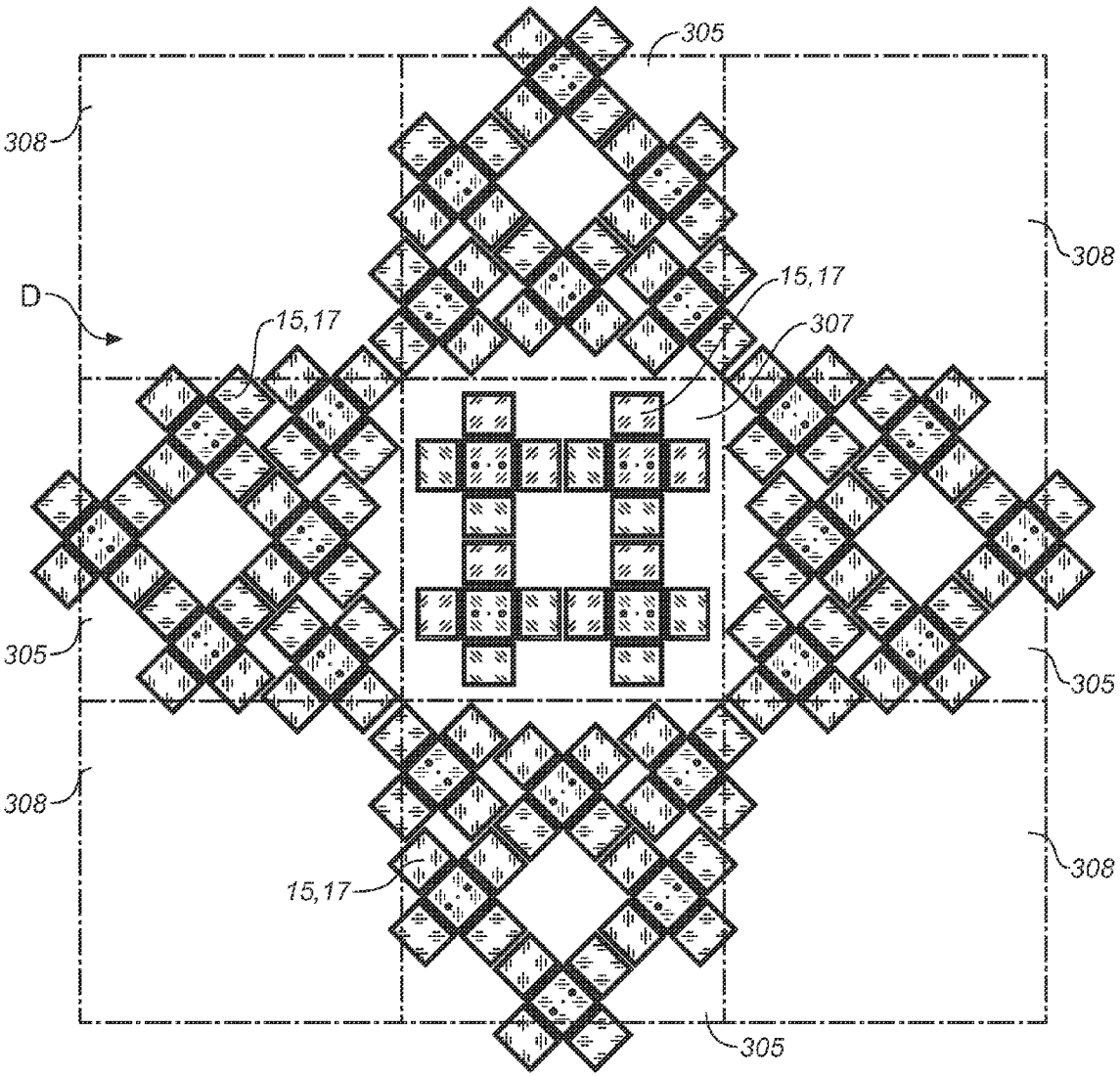
FIG. 25 shows an exemplary pattern of light modules on a grid ceiling that can be created with driver panels such as those shown in FIGS. 24A and 24B.

FIG. 25 shows an exemplary and relatively more complex ceiling lighting system configuration, denoted as layout "D," created using a combination of the different driver panels. Nine contiguous ceiling panels are represented by dashed line squares 305, 307 and 308. Dashed squares 305 represent driver panels having the connection points shown in FIG. 24A, while the dashed center square 307 represents a ceiling panel having the connection points shown in FIG. 24B. Dashed squares 308 represent ceiling panels that could be additional driver panels or ceiling panels that are not driver panels, such as acoustic ceiling tiles.

It will be appreciated that, with a few basic driver panels having a few different light module connector configurations, a wide variety of ceiling lighting system configurations can be created to addresses a wide variety of lighting needs. With the small footprint light modules described herein, compact lumen packages can be readily positioned on a grid ceiling in different cluster configurations to produce desired light distribution patterns within spaces. This would include open offices where more lumens may be required for task areas such as desktops than will be required for circulation areas. By deploying selected panel drivers in accordance with the invention in, for example, the grid ceiling of an open office, connection points provided by the driver panels can be selected for positioning compact light modules in accordance with the invention to deliver a different amount of lumens to different locations much more precisely than with conventional ceiling lighting systems. As a result, a system and method can be provided for illuminating a space with improved application efficiency as disclosed in commonly owned U.S. Provisional Application No. 61/447,657, which is incorporated herein by reference.

While various aspects of the configurable ceiling lighting system of the invention have been described herein in considerable detail, it is not intended that the invention, or any aspect of the invention, be limited to such detail, except as may be necessitated by the following claims.

What we claim is:

1. A configurable ceiling lighting system for a grid ceiling having a ceiling T-bar grid with grid openings for supporting ceiling tiles, comprising at least one driver panel having a bottom with an observable bottom surface and a defined perimeter sized to allow the driver panel to be set into and retained within a grid opening of a ceiling grid such that the bottom surface of the driver panel becomes a part of the observable grid ceiling, said driver panel having at least one mechanical connector and associated electrical connection accessible from the bottom thereof and defining a connection point on the bottom of said driver panel, said electrical connection being powered by an electrical power source, and at least one light module having a light source and a mechanical connector complimentary to the mechanical connector of said driver panel, and further having an electrical connection connectable to the electrical connection associated with the mechanical connector on the bottom of said driver panel, wherein, by using the available mechanical connector and electrical connection at the connection point on the bottom of said driver panel, said light module can be operatively connected to the bottom of said driver panel at said connection point so as to be deployed below the driver panel at the connection point thereof, and wherein the light module can be operatively configured below a grid ceiling having more than one of said driver panels or having a driver panel with more than one connection point.

2. The configurable ceiling lighting system of claim 1 wherein said driver panel has a plurality of mechanical connectors and associated electrical connections defining a plurality of connection points on the bottom of said panel, and wherein said light module can be connected to the bottom of said driver panel at any one of said connection points.

3. The configurable ceiling lighting system of claim 1 wherein the mechanical connector of said driver panel is recessed into the bottom of said driver panel.

4. The configurable ceiling lighting system of claim 3 further comprising a removable cover means for covering the mechanical connector in the bottom of said driver panel when not in use.

5. The configurable ceiling lighting system of claim 1 wherein the bottom surface of said driver panel has a surface treatment that resembles the observable surfaces of ceiling tiles of a grid ceiling.

6. The configurable ceiling lighting system of claim 1 wherein the bottom surface of said driver panel has a surface treatment that contrasts with the observable surfaces of ceiling tiles of a grid ceiling for aesthetic effect.

7. The configurable ceiling lighting system of claim 1 wherein said driver panel has a substantially planar low profile form factor.

8. The configurable ceiling lighting system of claim 7 wherein height of said driver panel is not greater than the height of a T-bar of a grid ceiling.

9. The configurable ceiling lighting system of claim 1 wherein said driver panel has a breath defined by the perimeter dimensions of said panel and wherein said light module has a footprint less than the breath of the driver panel.

10. The configurable ceiling lighting system of claim 9 wherein the driver panel is a square or rectangular panel having a perimeter dimension of approximately two feet and another perimeter dimension of approximately two feet or greater, and wherein the footprint of the light module is no greater than about one foot square.

11. The configurable ceiling lighting system of claim 9 wherein the light sources for said light module are comprised of at least one diffuse area light source.

12. The configurable ceiling lighting system of claim 9 wherein the light sources for said light module are comprised of a cluster of diffuse area light sources.

13. The configurable ceiling lighting system of claim 12 wherein the cluster of diffuse area light sources include diffuse area light sources that lie in different planes.

14. A configurable ceiling lighting system for a grid ceiling having a ceiling T-bar grid with grid openings for supporting ceiling tiles, comprising a plurality of low profile driver panels having a bottom with an observable bottom surface and a defined perimeter sized to allow the driver panel to be set into and be retained within a grid opening of a ceiling grid such that the bottom surface of the driver panel becomes a part of the observable grid ceiling, each of said driver panels having a plurality of mechanical connectors and associated electrical connections accessible from the bottom thereof and defining a plurality of connection points on the bottom of said panel, said electrical connections being powered by an electrical power source, and a plurality of light modules, each of said light modules having a light source and a mechanical connector complimentary to the any selected one of the mechanical connectors of said driver panel, and further having an electrical connection connectable to the electrical connection associated with any selected one of the mechanical connectors on the bottom of said driver panel, wherein, by using an available mechanical connector and associated electrical connection at a selected connection point on the bottom of said driver panel, said lighting modules can be operatively connected to the bottom of selected one of said driver panels at a selected one of the connection points thereon so as to deployed below the selected driver panel at the selected connection point, and wherein the light modules can be operatively configured below a grid ceiling having at least one of said driver panels.

15. The configurable ceiling lighting system of claim 14 wherein each driver panel including the bottom of the driver panels lies in an x-y plane, and wherein the plurality of mechanical connectors and associated electrical connections of each of said driver panels are distributed in the x-y plane of the driver panels to allow light modules to be arranged in groupings in the x-y plane of the panel.

16. The configurable ceiling lighting system of claim 14 wherein the mechanical connectors of said driver panels are recessed into the bottom of said driver panels.

17. The configurable ceiling lighting system of claim 16 further comprising a removable cover means for covering the mechanical connectors in the bottom of said driver panel when not in use.

18. The configurable ceiling lighting system of claim 14 wherein the mechanical connectors and associated electrical connections of the driver panels are comprised of banana plug sockets having insertion openings accessible from the bottom of the driver panels.

19. The configurable ceiling lighting system of claim 18 wherein the insertion openings of said banana plugs for each driver panel are substantially flush with the bottom surfaces at the bottom of said driver panels.

20. The configurable ceiling lighting system of claim 14 wherein the bottom surfaces of at least some of said driver panels have surface treatment that resembles the observable surfaces of ceiling tiles of a grid ceiling.

21. The configurable ceiling lighting system of claim 14 wherein the bottom surfaces of at least some of said driver panels have surface treatments that contrast with the observable surfaces of ceiling tiles of a grid ceiling for aesthetic effect.

22. The configurable ceiling lighting system of claim 14 wherein height of said driver panels is not greater than the height of a T-bar of a grid ceiling.

23. The configurable ceiling lighting system of claim 14 wherein each of said driver panels has a breadth defined by the perimeter dimensions of said panel driver and wherein each light module has a footprint less than the breadth of the driver panel.

24. The configurable ceiling lighting system of claim 23 wherein each driver panel is a square or rectangular panel having a perimeter dimension of approximately two feet and another perimeter dimension of approximately two feet or greater, and wherein the footprint of each light module is no greater than about one foot square.

25. The configurable ceiling lighting system of claim 24 wherein the light sources for said light modules are comprised of at least one diffuse area light source.

26. The configurable ceiling lighting system of claim 25 wherein said diffuse area light sources are substantially flat LED waveguide panels.

27. The configurable ceiling lighting system of claim 25 wherein said diffuse area light sources are QDLED panels.

28. The configurable ceiling lighting system of claim 24 wherein the light sources for said light modules are comprised of a cluster of diffuse area light sources.

29. The configurable ceiling lighting system of claim 28 wherein the cluster of diffuse area light sources include diffuse area light sources that lie in different planes.

30. The configurable ceiling lighting system of claim 24 wherein said diffuse area light sources are OLED panels.

31. The configurable ceiling lighting system of claim 14 wherein each of said driver panels has an incoming and outgoing wire cable that allows driver panels to be electrically connected together and to an external voltage source.

32. A configurable ceiling lighting system for a grid ceiling having a ceiling T-bar grid with grid openings for supporting ceiling tiles, comprising a plurality of planar low profile driver panels having a bottom with an observable bottom surface lying in an x-y plane and a defined perimeter sized to allow the driver panel to be set into and be retained within a grid opening of a ceiling grid such that the bottom surface of the driver panel becomes a part of the observable grid ceiling, each of said driver panels having a breadth defined by the perimeter dimensions of said panel driver and having a plurality of mechanical connectors and associated electrical connections at the bottom thereof defining an array of connection points in the x-y plane at the bottom surface of the driver panels, and a plurality of OLED light modules, each of said light modules having at least one OLED panel, and a mechanical connector complimentary to any selected one of the mechanical connectors of said driver panels, and further having an electrical connection connectable to the electrical connection associated with any selected one of the mechanical connectors on the bottom of said driver panel, wherein, by using an available mechanical connector and associated electrical connection at a selected connection point on the bottom of said driver panel, said lighting modules can be operatively connected to the bottom of said driver panels at any one of the array of connection points thereon, and wherein the light modules can be configured on and operatively connected to a grid ceiling having at least one of said driver panels, wherein the lighting modules are deployed below the grid ceiling at the selected connection points of the driver panel, each of said light modules having a footprint that is less than the breadth of the driver panel.

33. The configurable ceiling lighting system of claim 32 wherein said OLED light modules are comprised of a cluster of OLED panels.

34. The configurable ceiling lighting system of claim 33 wherein the cluster of OLED panels include OLED panels that lie in different planes.

35. The configurable ceiling lighting system of claim 34 wherein each of said driver panels has an incoming and outgoing wire cable that allows driver panels to be electrical connected together and to an external voltage source.

* * * * *